US009522560B2

(12) United States Patent
Paulick et al.

(10) Patent No.: US 9,522,560 B2
(45) Date of Patent: Dec. 20, 2016

(54) CLIPBOARD

(71) Applicant: Jimmy John Design, LLC, Philadelphia, PA (US)

(72) Inventors: John F. Paulick, Philadelphia, PA (US); James J. Caldwell, Philadelphia, PA (US)

(73) Assignee: CLIPBOOK, LLC

( * ) Notice: Subject to any disclaimer, the term of this patent is extended or adjusted under 35 U.S.C. 154(b) by 60 days.

(21) Appl. No.: 14/508,591

(22) Filed: Oct. 7, 2014

(65) Prior Publication Data

US 2015/0096157 A1 Apr. 9, 2015

Related U.S. Application Data

(63) Continuation-in-part of application No. 29/469,225, filed on Oct. 8, 2013, now Pat. No. Des. 724,666.

(60) Provisional application No. 62/007,919, filed on Jun. 4, 2014.

(51) Int. Cl.

| | |
|---|---|
| ***B42F 5/00*** | (2006.01) |
| ***B42F 1/00*** | (2006.01) |
| ***B42F 9/00*** | (2006.01) |
| ***B42F 11/04*** | (2006.01) |

(52) U.S. Cl.

CPC ..... *B42F 9/001* (2013.01); *B42F 9/002* (2013.01); *B42F 11/04* (2013.01); *Y10T 24/20* (2015.01); *Y10T 24/32* (2015.01)

(58) Field of Classification Search

CPC ..... B42F 1/00; B42F 9/001; B42F 11/04; B42F 1/00; Y10T 24/32; Y10T 24/20; B42D 5/005; A45C 13/1069; B45F 5/00

USPC 206/45.23; 40/661.01; 402/503; 281/DIG. 1

See application file for complete search history.

(56) References Cited

U.S. PATENT DOCUMENTS

| | | | |
|---|---|---|---|
| 328,470 | A | 10/1885 | Dearden |
| 384,655 | A | 6/1888 | Ward |
| 400,920 | A | 4/1889 | Krouse |
| 404,760 | A | 6/1889 | Wisner |
| 1,543,430 | A | 6/1925 | Fischer |
| 1,614,977 | A | 1/1927 | Ausmus |
| 2,080,591 | A | 5/1937 | Wright |
| 2,704,216 | A | 7/1951 | Slonneger |
| 3,008,470 | A | 11/1961 | Rubinstein |
| 3,119,738 | A | 1/1964 | Wentges |
| 3,228,709 | A | 1/1966 | Tooker |
| 3,318,618 | A | 5/1967 | Mullen et al. |
| 3,347,565 | A | 10/1967 | Konkel |

(Continued)

FOREIGN PATENT DOCUMENTS

| | | | |
|---|---|---|---|
| AU | 2013100893 | A4 * | 8/2013 |
| EP | 1148997 | | 10/2003 |

*Primary Examiner* — Robert J Sandy
*Assistant Examiner* — Michael Lee
(74) *Attorney, Agent, or Firm* — The Belles Group, P.C.

(57) ABSTRACT

A clipboard having first and second panels that are integrally coupled together. In one embodiment, the clipboard comprises a first panel having a top end; a second panel having a top end, the first and second panels coupled together by a first hinge connecting the top end of the first panel to the top end of the second panel; the second panel comprising: a second hinge that divides the second panel into a cover portion and a clip portion; and a third hinge that divides the clip portion of the second panel into a first section and a second section.

18 Claims, 17 Drawing Sheets

(56) References Cited

U.S. PATENT DOCUMENTS

| | | | | |
|---|---|---|---|---|
| 4,007,950 | A * | 2/1977 | Giulie | B42D 1/06 281/27.3 |
| 4,255,837 | A | 3/1981 | Holtz | |
| 4,588,209 | A | 5/1986 | Zebrowski et al. | |
| 4,892,334 | A | 1/1990 | Sinclair | |
| 5,413,382 | A | 5/1995 | Cornell et al. | |
| 5,474,333 | A | 12/1995 | Schrader | |
| 5,709,409 | A | 1/1998 | Engel | |
| 5,887,902 | A | 3/1999 | Irwin et al. | |
| 6,024,384 | A | 2/2000 | Jones et al. | |
| 6,213,439 | B1 * | 4/2001 | Giulie | A47B 97/04 248/459 |
| 6,637,774 | B2 | 10/2003 | Gaska | |
| 6,793,251 | B2 | 9/2004 | Stark | |
| D534,952 | S | 1/2007 | Wittmeyer, Jr. | |
| 7,673,908 | B2 | 3/2010 | Liptan | |
| D660,356 | S | 5/2012 | Moross et al. | |
| 8,847,979 | B2 * | 9/2014 | Smith | G06F 3/01 345/169 |
| 8,884,730 | B2 * | 11/2014 | Lauder | H01F 7/04 206/320 |
| 2009/0206592 | A1 | 8/2009 | Summerhayes | |
| 2010/0084848 | A1 | 4/2010 | Nguyen | |
| 2012/0268891 | A1 | 10/2012 | Cencioni | |
| 2013/0177181 | A1 | 7/2013 | Marcus | |
| 2015/0001105 | A1 * | 1/2015 | Nyholm | A45C 11/00 206/45.2 |
| 2015/0316999 | A1 * | 11/2015 | Harms | G06F 3/023 345/169 |

* cited by examiner

CLIPBOARD

CROSS-REFERENCE TO RELATED APPLICATIONS

The present application claims priority to U.S. Provisional Patent Application Ser. No. 62/007,919, filed Jun. 4, 2014, and is a continuation-in-part of U.S. Design patent application Ser. No. 29/469,225, filed Oct. 8, 2013, the entireties of which are incorporated herein by reference.

FIELD OF THE INVENTION

The present invention relates generally to a clipboard, and more specifically to a clipboard having first and second panels that are integrally coupled together.

BACKGROUND OF THE INVENTION

The conventional clipboard is made up of a rigid panel that has a bulky clip attached thereto. The clip can be adjusted between an open position and a closed position. When in the open position a gap is formed between the clip and the rigid panel so that paper or other items can be inserted between the clip and the rigid panel. When in the closed position the paper or other items are sandwiched between the clip and the rigid panel. Paper that is held by the clipboard can be written on because the rigid panel forms a rigid writing surface. Although conventional clipboards serve their purpose, they are outdated and leave much to be desired. Furthermore, conventional clipboards do not offer any protection of the item retained thereon. Further still, conventional clipboards leave papers retained thereby exposed and visible so such papers may be readily accessible to passersby, which may be undesirable if, for example, the clipboard is holding a person's medical records. Thus, a need exists for a new and improved clipboard that cures the drawbacks of the conventional clipboard while being easy to manufacture and aesthetically pleasing.

BRIEF SUMMARY OF THE INVENTION

Exemplary embodiments according to the present disclosure are directed to a clipboard. The clipboard may have first and second panels that are coupled together by a first hinge at their top ends. Furthermore, the second panel may comprise a second hinge and a third hinge. The second hinge divides the second panel into a cover portion and a clip portion. The third hinge divides the cover portion into a first section and a second section. The structure of the clipboard enables the second panel to be adjustable between open and closed positions in a manner similar to the way that a sheet of paper in a legal pad is flipped.

In one aspect, the invention can be a clipboard comprising: a rigid first panel having a front surface, a rear surface, and a top end, the first panel comprising a first magnet; a second panel having a front surface, a rear surface, and a top end, the first and second panels coupled together by a first hinge connecting the top end of the first panel to the top end of the second panel; the second panel comprising: a second hinge that divides the second panel into a cover portion and a clip portion; and a third hinge that divides the clip portion of the second panel into a first section and a second section, the first section comprising a second magnet; wherein the second panel is adjustable between: (1) a closed position in which the second panel overlies the front surface of the first panel; and (2) an open position in which the cover portion of the second panel is adjacent to the rear surface of the first panel, the second section of the clip portion of the second panel overlies the first section of the clip portion of the second panel, the first section of the clip portion of the second panel overlies a top portion of the front surface of the first panel, and a bottom portion of the front surface of the first panel is exposed; and wherein opposite poles of the first and second magnets are aligned when the second panel is in both the open and closed positions to releasably secure, via magnetic attractive forces between the first and second magnets, the first section of the clip portion to the first panel to form a clip of the clipboard.

In another aspect, the invention can be a clipboard comprising: a first panel having a top end; a second panel having a top end, the first and second panels coupled together by a first hinge connecting the top end of the first panel to the top end of the second panel; the second panel comprising: a second hinge that divides the second panel into a cover portion and a clip portion; and a third hinge that divides the clip portion of the second panel into a first section and a second section; wherein the second hinge has a first width measured between the cover portion of the second panel and the second section of the clip portion of the second panel, and wherein the third hinge has a second width measured between the first section of the clip portion and the second section of the clip portion, the first width being greater than the second width.

In yet another embodiment, the invention can be a clipboard comprising: a rigid first panel having a top end; a rigid second panel having a top end, the first and second panels coupled together by a first hinge connecting the top end of the first panel to the top end of the second panel; the second panel comprising: a second hinge that divides the second panel into a cover portion and a clip portion; and a third hinge that divides the clip portion of the second panel into a first section and a second section.

In a further aspect, the invention can be a clipboard comprising: a first panel extending from a bottom end to a top end and comprising a front surface, a rear surface, and a first magnet; a second panel extending from a bottom end to a top end and comprising a front surface, a rear surface, and a second magnet, the first and second panels coupled together by a first hinge connecting the top end of the first panel to the top end of the second panel; a third panel comprising a front surface, a rear surface, and a third magnet, the third panel coupled to the bottom end of the first panel by a second hinge; wherein the clipboard is adjustable between: (1) a closed state in which the front surface of the third panel is adjacent to a bottom portion of the front surface of the first panel, and the rear surface of the second panel is adjacent to the rear surface of the third panel and to a top portion of the front surface of the first panel; and (2) an open state in which the second panel is rotated about the first hinge to expose the top portion of the front surface of the first panel; and wherein opposite poles of the first and third magnets and opposite poles of the second and third magnets are aligned when the clipboard is in the closed state to releasably secure the third panel to the first panel via magnetic attractive forces between the first and third magnets and to releasably secure the second panel to the third panel via magnetic attractive forces between the second and third magnets.

In a still further aspect, the invention can be a clipboard comprising: a first panel comprising a bottom end, a top end, a front surface, a rear surface, and a first magnet; a second panel comprising a top end, a front surface, a rear surface, and a second magnet, the first and second panels coupled together by a first hinge connecting the top end of the first panel to the top end of the second panel; a third panel comprising a front surface, a rear surface, and a third magnet, the third panel coupled to the bottom end of the first panel by a second hinge; wherein when the clipboard is in a closed state: (1) the front surface of the third panel is adjacent to a bottom portion of the front surface of the first panel and opposite poles of the first and third magnets are aligned to releasably secure, via magnetic attractive forces between the first and third magnets, the third panel to the first panel; and (2) the rear surface of the second panel is adjacent to the rear surface of the third panel so that opposite poles of the second and third magnets are aligned to releasably secure, via magnetic attractive forces between the second and third magnets, the second panel to the third panel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
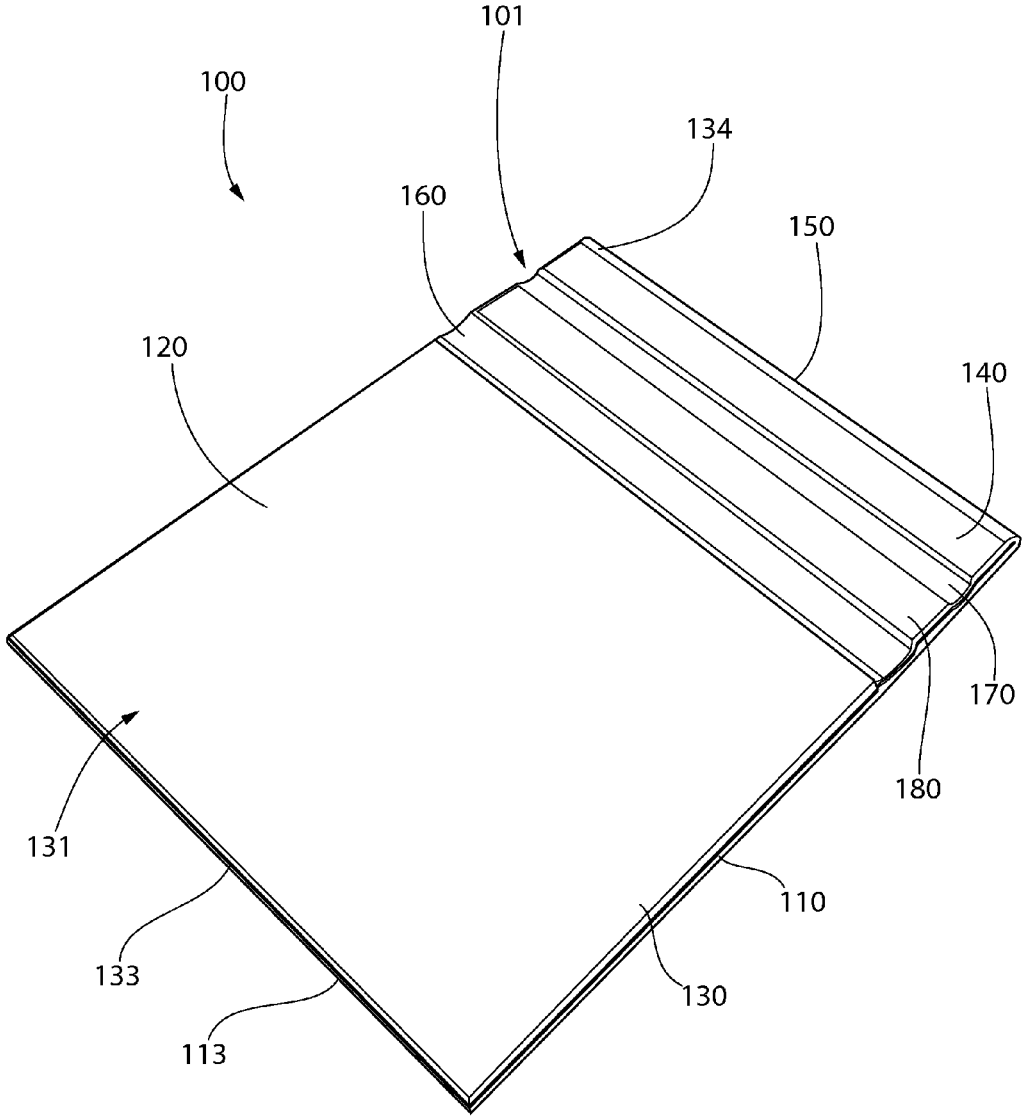
FIG. 1 is a front perspective view of a clipboard in accordance with a first embodiment of the present invention, wherein a second panel of the clipboard is in a closed position.
Figure 3:
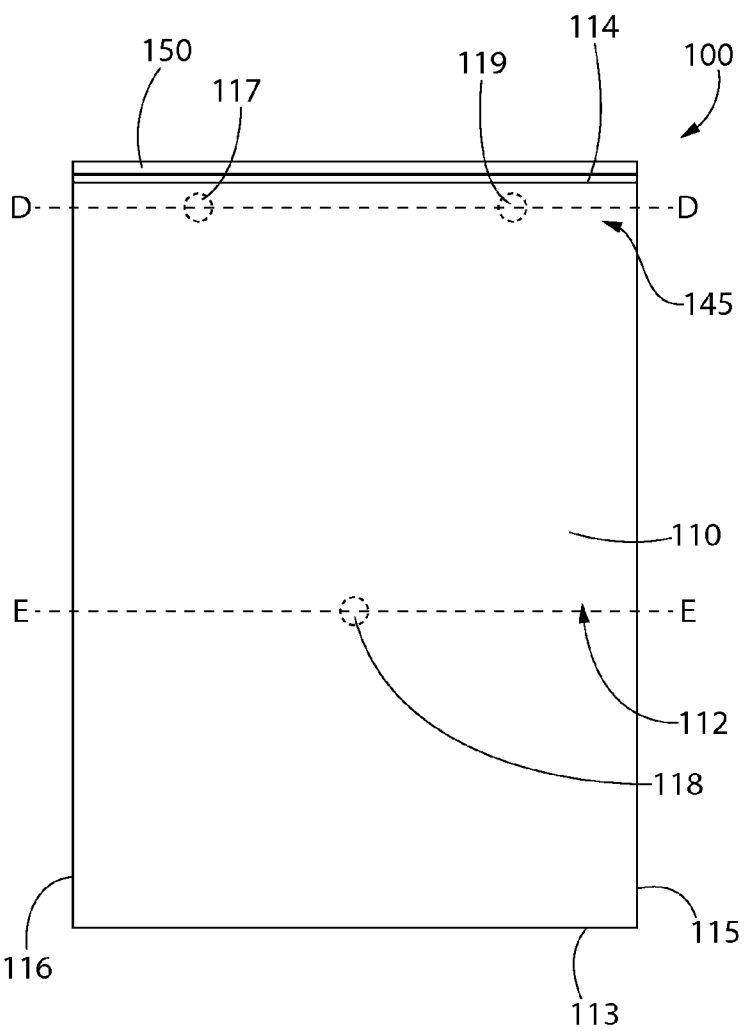
FIG. 3 is a rear view of the clipboard of FIG. 1.
Figure 2:
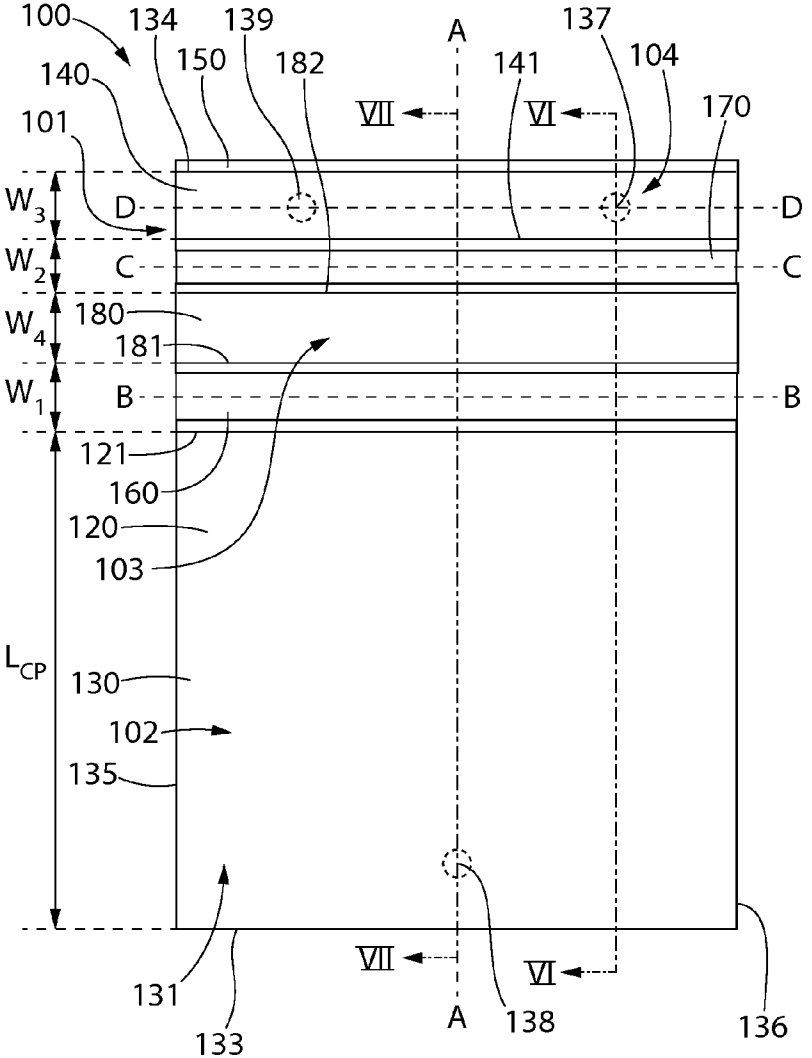
FIG. 2 is a front view of the clipboard of FIG. 1.
Figure 4:
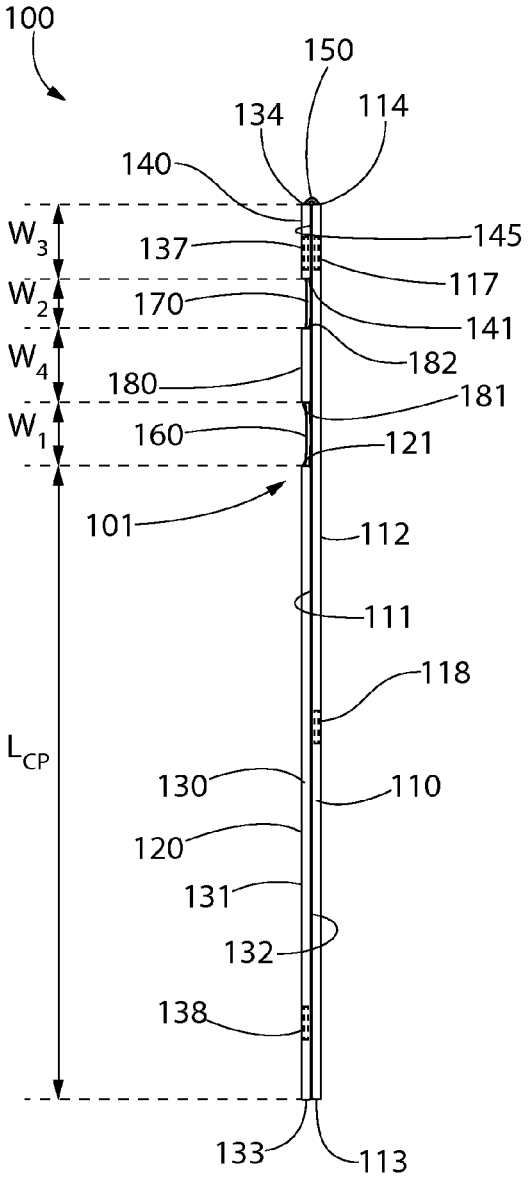
FIG. 4 is a right-side view of the clipboard of FIG. 1.
Figure 5:
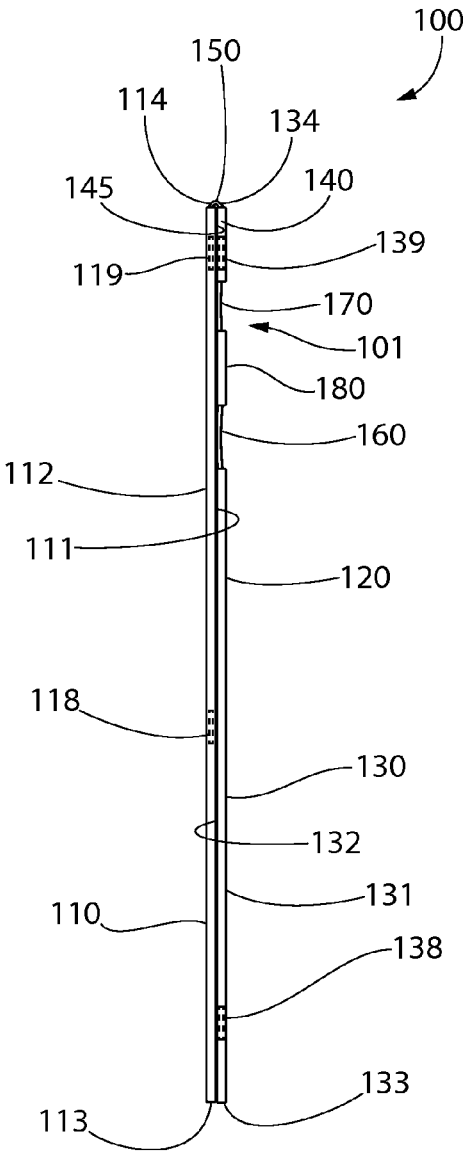
FIG. 5 is a left-side view of the clipboard of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIGS. 1-7 concurrently, a clipboard 100 will be described in accordance with an embodiment of the present invention. The clipboard 100 generally comprises a first panel 110 and a second panel 130 that are coupled together as described herein below to form a single unitary structure that operates as a clipboard for retaining items between the first and second panels 110, 130. In some embodiments the first panel 110 may be considered a rear panel and the second panel 130 may be considered a front panel or cover panel. Thus, the first panel 110 may form a writing surface for items retained by the clipboard 100 and the second panel 130 may be used for privacy or protection of items retained by the clipboard 100.

Furthermore, in certain embodiments the first panel 110 is rigid or is formed of a rigid material. Thus, the first panel 110 may be formed of one or more layers of cardboard that provide the first panel 110 with its rigidity. In certain embodiments, the first panel 110 may be formed in a manner similar to a hardcover for a book. In that regard, the first panel 110 may be formed of one or more book board panels, chipboard, or the like. Of course, the invention is not to be particularly limited by the material that is used to form the first panel 110 in all embodiments and the first panel 110 can be formed of other materials that are known to be rigid in that they cannot be bent or deflected more than a minute amount without breaking.

In certain embodiments the first panel 110 has a length and a width, and when the first panel 110 is held by one end in a cantilevered manner along its length the first panel 110 deflects no more than 5°-10°. The rigidity of the first panel 110 is desirable so that when the clipboard 100 is being used to retain paper, a user can write on the paper while the paper is in contact with the first panel 110 so that the first panel 110 acts as a rigid writing surface. In that regard, the rigidity of the first panel 110 is such that if a user is writing on paper that is positioned on the first panel 110, the first panel 110 remains stiff and will not bend during such writing. In certain embodiments, the rigidity of the first panel 110 is the same as that of the cover for a hardcover book because the first panel 110 may be manufactured using standard book-binding techniques. Furthermore, although the materials are described above with regard to the first panel 110, it should be appreciated that in certain embodiments the second panel 130 is formed of the same material as the first panel 110.

In the exemplified embodiment, the first panel 110 is a flat, planar structure having a front surface 111, a rear surface 112, a bottom end 113, a top end 114, a first side edge 115, and an opposing second side edge 116. Each of the front and rear surfaces 111, 112 of the first panel 110 are flat and planar and have no ridges, undulations, indentations, or the like. However, the invention is not to be so limited in all embodiments and in certain other embodiments some ridges, undulations, indentations, or the like may be included on the front and/or rear surfaces 111, 112. The second panel 130 is also a flat, planar structure having a front surface 131, a rear surface 132, a bottom end 133, a top end 134, a first side edge 135, and an opposing second side edge 136. The clipboard 100 extends along a longitudinal axis A-A from the bottom ends 113, 133 of the first and second panels 110, 130 to the top ends 114, 134 of the first and second panels 110, 130. The first and second panels 110, 130 are coupled together by a first hinge 150 that connects the top end 113 of the first panel 110 to the top end 133 of the second panel 130. In the exemplified embodiment, the first and second panels 110, 130 and the first hinge 150 are formed as an integral structure and the first hinge 150 forms a living hinge. More specifically, in the exemplified embodiment the first hinge 150 is formed by a portion of the clipboard 100 that has a reduced thickness relative to the top ends 114, 134 of the first and second panels 110, 130. Thus, despite their rigidity, the first and second panels 110, 130 are able to rotate relative to one another about the first hinge 150.

Although the first hinge 150 is illustrated and described herein as being a living hinge formed of a portion of the clipboard 100 having a reduced thickness relative to the portions of the clipboard 100 to which it is coupled, the invention is not to be so limited in all embodiments. In that regard, the first hinge 150 can take on any of a plurality of different forms, such as being a butt hinge, a T-hinge, a strap hinge, a gate hinge, a butterfly hinge, a barrel hinge, or the like. Thus, the exact structure used to form the first hinge 150 is not to be limiting in all embodiments and the first hinge 150 can be formed by any structure that permits relative movement between the first and second panels 110, 130 as described in more detail below.

While the first panel 110 forms a rear panel or writing surface of the clipboard 100, the first panel 130 forms a front panel or cover of the clipboard 100 and can be used to cover and protect documents, papers, or other items that are retained between the first and second panels 110, 130. FIGS. 1-7 illustrate the clipboard 100 with the second panel 130 in a closed position in which the second panel 130 overlies the first panel 110. More specifically, in the closed position the rear surface 132 of the second panel 130 is adjacent to and covers the front surface 111 of the first panel 110. In the exemplified embodiment, no portion of the front surface 111 of the first panel 110 is exposed when the second panel 130 is in the closed position because the second panel 130 covers the entirety of the front surface 111 of the first panel 110. Of course, the invention is not to be so limited in all embodiments and the first panel 110 may be larger than the second panel 130 so that portions of the first panel 110 remain exposed even in the closed position. As a result of the second panel 130 overlying and covering the first panel 110, any papers or other items retained by the clipboard 100 will be trapped between the first and second panels 110, 130 and protected against damage from the elements. Furthermore, trapping or sandwiching the retained item between the first and second panels 110, 130 hides the item from view of the general public so that if the retained item is not one which is desired to be shared with the public, such as medical records, tax documents, other documents containing personal information, or the like, the clipboard 100 will accomplish this goal. Thus, the closed position of the second panel 130 provides privacy and protection to any item retained by the clipboard 100.

The second panel 130 of the clipboard 100 comprises several sections that are formed by hinges or the like which facilitate the functionality of the clipboard 100 illustrated in FIG. 9, which will be described in more detail below. Specifically, the second panel 130 comprises a second hinge 160 that divides the second panel 130 into a cover portion 120 and a clip portion 101. Furthermore, the second panel 130 comprises a third hinge 170 that divides the clip portion 101 into a first section 140 and a second section 180. In the exemplified embodiment, each of the second and third hinges 160, 170 is formed by a portion of the second panel 130 that has a reduced thickness relative to adjacent portions of the second panel 130, and thus each of the second and third hinges 160, 170 is a living hinge. Specifically, the second hinge 160 has a thickness that is less than the thicknesses of each of the cover portion 120 and the second section 180 of the clip portion 101. Furthermore, the third hinge 170 has a thickness that is less than a thickness of each of the first and second sections 140, 180 of the clip portion 101. Of course, the second and third hinges 160, 170 need not be formed by reduced thickness in all embodiments and can be any other type of hinge, such as those described above with regard to the first hinge 150 or any other type of hinge known to those of skill in the art.

In certain embodiments the second panel 130 comprises a rigid material (such as the materials described above with regard to the first panel 110) that forms each of the cover portion 120 and the first and second sections 140, 180 of the clip portion 101. Specifically, during manufacturing of the clipboard 100, the rigid materials that form the cover portion 120 and each of the first and second sections 140, 180 of the clip portion 101 are initially separate from one another, although they may be coupled together using tape or some other coupling mechanism. To form the finished clipboard 100, the rigid material forming the cover portion 120 and the first and second sections 140, 180 of the clip portion 101 and the rigid material forming the first panel 110 are collectively covered or wrapped with an integral outer covering 109 (see FIGS. 6-8) that forms the exposed portions of the clipboard 100. Thus, once the outer covering 109 is applied to the first panel 110 and the second panel 130 (specifically to the cover portion 120 and the first and second sections 140, 180 of the clip portion 101 of the second panel 130), the clipboard 100 is a unitary structure. Thus, the first panel 110 comprises the rigid material noted above and a portion of the outer covering 109 that covers/surrounds the rigid material forming the first panel 110. The second panel 130 comprises the rigid material forming the cover portion 120 and the first and second sections 140, 180 of the dip portion 101 and the portion of the outer covering 109 that covers/surrounds those components.

Before the outer covering 109 is applied/made to cover the rigid portions of the first and second panels 110, 130, the cover portion 120 is spaced apart from the second section 180 of the clip portion 101 by a gap, the second section 180 of the clip portion 101 is spaced apart from the first section 140 of the clip portion 101 by a gap, and the first section 140 of the clip portion 101 is spaced apart from the first panel 110 by a gap. The outer covering 109 covers the rigid components of the first and second panels 110, 130 and also passes over the gaps to form the unitary clipboard 100 structure. In the exemplified embodiment, the outer covering 109 located at the gaps is what forms the first, second, and third hinges 150, 160, 170 of the second panel 130. Thus, the outer covering 109 is preferably formed of a pliable or flexible material that is able to flex and bend in order to form the first, second, and third hinges 150, 160, 170. In certain embodiments, the outer covering 109 may be any desired material, including linen (or book linen), leather, high quality book cloth, single or multi-layer laminate, paper products, vinyl, or the like, although the invention is not to be so limited in all embodiments. Furthermore, although a bookbinding technique is described herein above for forming the clipboard 100, in other embodiments the clipboard 100 can be manufactured using heat sealing methods or other techniques known in the art and the invention is not to be limited by the specific examples specified herein in all embodiments.

In the exemplified embodiment, the third hinge 170 is located between the first and second hinges 150, 160 and the second section 180 of the clip portion 101 is located between the cover portion 120 and the first section 140 of the clip portion 101. Thus, heading in a direction from the bottom edge 133 of the second panel 130 to the top edge 134 of the second panel 130, the second panel comprises the cover portion 120, the second hinge 160, the second section 180 of the clip portion 101, the third hinge 170, and the first section 140 of the clip portion 101. The first section 140 of the clip portion 101 of the second panel 130 comprises the top end 134 of the second panel 130, and thus the first section 130 of the clip portion 101 of the second panel 130 is coupled to the second panel 110 via the first hinge 150.

In the exemplified embodiment, the second hinge 160 extends along a first axis B-B and the third hinge 170 extends along a second axis C-C, the first and second axes B-B, C-C being substantially parallel to one another. Furthermore, each of the first and second axes B-B, C-C is substantially perpendicular to the longitudinal axis A-A of the clipboard 100. In the exemplified embodiment, each of the second and third hinges 160, 170 is formed by a reduced thickness portion of the second panel 130 (a portion of the second panel 130 that is devoid of a rigid material and is only formed by the outer covering 109) that extends from the first side edge 135 of the second panel 130 to the second side edge 136 of the second panel 130. This enables the cover portion 120 to rotate relative to the clip portion 101 about the second hinge 160. This further enables the second section 180 of the clip portion 101 to rotate relative to the first section 140 of the clip portion 101 about the third hinge 170.

The second hinge 160 has a first width $W_1$ measured between a top edge 121 of the cover portion 120 of the second panel 130 and a bottom edge 181 of the second section 180 of the clip portion 101 of the second panel 130. The third hinge 170 has a second width $W_2$ measured between a top edge 182 of the second section 180 of the clip portion 101 and a bottom edge 141 of the first section 140 of the clip portion 101. In the exemplified embodiment, the first width $W_1$ is greater than the second width $W_2$. In certain embodiments, a ratio of the first width $W_1$ to the second width $W_2$ is between 1.5:1 and 3:1, and more specifically approximately between 1.7:1 and 2:1. Although not required in all embodiments, forming the first width $W_1$ to be larger than the second width $W_2$ facilitates enabling the second hinge 160 to wrap around the top edges 114, 134 of the first and second panels 110, 130 when the second panel 130 is in an open position described in more detail below with reference to FIGS. 9-20.

Furthermore, in the exemplified embodiment the first section 140 of the clip portion 101 has a third width $W_3$ measured between the first and third hinges 150, 170. The second section 180 of the clip portion 101 has a fourth width $W_4$ measured between the second and third hinges 170, 180. In the exemplified embodiment, the third and fourth widths $W_3$, $W_4$ are substantially the same. Furthermore, the cover portion 120 of the second panel 130 has a length $L_{CP}$ measured between the bottom edge 133 of the second panel 130 and the top edge 121 of the cover portion 120. In the exemplified embodiment, the length $L_{CP}$ of the cover portion 120 is greater than each of the first and second widths $W_1$, $W_2$. In certain embodiments a ratio of the length $L_{CP}$ of the cover portion 120 to the first and second widths $W_1$, $W_2$ is between 7:1 and 10:1. Furthermore, in the exemplified embodiment the cover portion 120 is devoid of any hinges along its entire length $L_{CP}$ from the bottom edge 133 of the second panel 130 to the top edge 121 of the cover portion 120.

In certain embodiments a ratio of each of the third and fourth widths $W_3$, $W_4$ to the first width $W_1$ is between 1:1 and 2:1, and more specifically between 1.1:1 and 1.5:1, and still more specifically approximately 1.3:1. Furthermore, a ratio of each of the third and fourth widths $W_3$, $W_1$ to the second width $W_2$ is between 2:1 and 3:1, and more specifically between 2.1:1 and 2.5:1, and still more specifically approximately 2.3:1. Furthermore, in certain embodiments a ratio of the length $L_{CP}$ of the cover portion 120 to the collective widths $W_1+W_2+W_3+W4$ is between 2:1 and 3:1, more specifically between 2.4:1 and 2.8:1, and still more specifically approximately 2.6:1. These ratios are preferable in certain embodiments to ensure that the clip portion 101 has sufficient width to retain items on the clipboard 100.

In the exemplified embodiment, the clipboard 100 has an overall length of approximately 12 inches and an overall width of approximately 9 inches. Thus, in the exemplified embodiment the clipboard 100 is intended to retain and hold notebook paper, a legal pad, or the like. However, the invention is not to be limited by the overall length and width of the clipboard 100 in all embodiments. Of course, the invention is not to be limited by the dimensions and ratios of the various sections of the clipboard 100 in all embodiments and the clipboard 100 may be manufactured in varying sizes and dimensions while retaining its functionality described herein. Thus, the clipboard 100 may be made smaller to retain smaller items or larger to retain larger items. The size of the clipboard 100 may be configured for use in holding portfolio paper, drawing and/or painting paper, scrapbooking materials, photographs of various sizes, menus, wine lists, and can even be wallet sized so as to fit in a person's wallet or purse.

As noted above, the second panel 130 comprises a front surface 131. However, to facilitate an understanding of the relative positioning of the various sections/portions of the second panel 130, the front surface 131 of the second panel 130 can be divided as follows. The cover portion 120 comprises a first portion 102 of the front surface 131 of the second panel 130. The second section 180 of the dip portion 101 comprises a second portion 103 of the front surface 131 of the second panel 130. The third section 140 of the clip portion 101 comprises a third portion 104 of the front surface 131 of the second panel 130. In the closed state depicted in FIGS. 1-7, the first and second sections 140, 180 of the dip portion 101 of the second panel 101 are longitudinally spaced apart from one another by the third hinge 170. Furthermore, as noted above in the exemplified embodiment when the second panel 130 is in the closed position no portion of the front surface 111 of the first panel 110 is exposed.

In the exemplified embodiment, the first panel 110 comprises a first magnet 117, a fourth magnet 118, and a fifth magnet 119. In the exemplified embodiment, each of the first, fourth, and fifth magnets 117-119 are disc magnets that are embedded within the first panel 110 so that no portion of the first, fourth, and fifth magnets 117-119 is exposed. Specifically, in the exemplified embodiment, each of the magnets 117, 118, 119 is located within a hole or cut-out that is formed into the first panel 110. However, the invention is not to be so limited and one or more of the first, fourth, and fifth magnets 117-119 may be exposed on an outer surface the front or rear surfaces 111, 112) of the first panel 110 in other embodiments. Furthermore, one or more of the first, fourth, and fifth magnets 117-119 need not be disc-shaped magnets in all embodiments and can take on any desired shape or form. Thus, the first, fourth, and fifth magnets 117-119 may be elongated in shape, may be formed by magnetic particles that are embedded within the first panel 110 at various desired locations, or the like. Furthermore, although described herein as being first, fourth, and fifth magnets 117-119, in certain embodiments the magnets 117-119 may be replaced by other fastening elements. For example, instead of magnets 117-119, the first panel 110 may comprise one-half of a hook-and-loop fastener (i.e., hooks or loops), an adhesive, a button or buttonhole, or the like.

In the exemplified embodiment, the first magnet 117 and the fifth magnet 119 are located in a top portion 145 of the first panel 110, are longitudinally aligned with one another along a transverse axis D-D, and are transversely spaced apart from one another so that the first magnet 117 is closer to the second side edge 116 of the first panel 110 and the fifth magnet 119 is closer to the first side edge 115 of the first panel 110. More specifically, in the exemplified embodiment the width of the first panel 110 measured between the first and second side edges 115, 116 is approximately 9 inches, and the first magnet 117 is spaced approximately 2 inches from the second side edge 116 and the fifth magnet 119 is spaced approximately 2 inches from the first side edge 115. Of course, other widths of the first panel 110 are possible and other locations for the first and fifth magnets 117, 119 are possible. Furthermore, although two magnets 117, 119 are depicted in the exemplified embodiment, the invention is not to be so limited and a single magnet can be used in some embodiments and positioned in the top portion 145 of the first panel 110 along the transverse axis D-D, or more than two magnets can be positioned in the top portion 145 of the first panel 110 along the transverse axis D-D in some embodiments.

The fourth magnet 118 is located in a central region of the first panel 110 between the left and right side edges 115, 116 of the first panel 110. However, the fourth magnet 118 may be positioned closer to either one of the left and right side edges 115, 116 of the first panel 110 in other embodiments. In the exemplified embodiment, a transverse axis E-E that is perpendicular to the longitudinal axis A-A intersects the fourth magnet 118. Furthermore, although a single fourth magnet 118 is depicted in the drawings, more than one magnet may be positioned along the transverse axis E-E in some embodiments. Furthermore, in some embodiments the fourth magnet 118 may be entirely omitted, or may be substituted by another type of fastening element such as those described above.

The fourth magnet 118 is spaced from the bottom edge 113 of the first panel 110 by between 35% and 50%, and more specifically between 40% and 45% of the length of the first panel 110 measured between the bottom and top edges 113, 114 of the first panel 110. Specifically, in the exemplified embodiment the first panel 110 has a length measured from the bottom edge 113 to the top edge 114 of approximately 12 inches and the fourth magnet 118 is spaced approximately 5 inches from the bottom edge 113. The fourth magnet 118 is so positioned so that it comes into alignment with a magnet on the second panel 130 when the second panel 130 is in the open position as described in more detail below. Specifically, when the second panel 130 is in the open position the bottom edge 133 of the second panel 130 is located between the bottom edge 113 of the first panel 110 and the top edge 114 of the first panel 110. Thus, the fourth magnet 118 must be positioned at a location on the first panel 110 that is overlapped by the second panel 130 when the second panel 130 is in the open position in order for a magnet on the second panel 130 to be in alignment with the fourth magnet 118.

The second panel 130 comprises a second magnet 137, a third magnet 138, and a sixth magnet 139. More specifically, the first section 140 of the clip portion 101 of the second panel 130 comprises the second and sixth magnets 137, 139 and the cover portion 120 of the second panel 130 comprises the third magnet 138. In the exemplified embodiment, each of the second, third, and sixth magnets 137-139 are disc magnets that are embedded within the second panel 130 so that no portion of the magnets 137-139 is exposed. Specifically, in the exemplified embodiment, each of the magnets 137-139 is located within a hole or cut-out that is formed into the first panel 130. However, the invention is not to be so limited and one or more of the second, third, and sixth magnets 137-139 may be exposed on an outer surface (i.e., the front or rear surfaces 131, 132) of the second panel 130 in other embodiments. Furthermore, one or more of the second, third, and sixth magnets 137-139 need not be disc-shaped magnets in all embodiments and can take on any desired shape or form. Thus, the second, third, and sixth magnets 137-139 may be elongated in shape, may be formed by magnetic particles that are embedded within the second panel 130 at various desired locations, or the like. Furthermore, although described herein as being second, third, and sixth magnets 137-139, in certain embodiments the second, third, and sixth magnets 137-139 may be replaced by other fastening elements. For example, instead of magnets 137-

139, the second panel 130 may comprise one-half of a hook-and-loop fastener, an adhesive, a button or buttonhole, or the like.

In the exemplified embodiment, the second and sixth magnets 137, 139 are positioned on the transverse axis D-D. Thus, the second and sixth magnets 137, 139 are positioned on the second panel 130 along the transverse axis D-D and the first and fifth magnets 117, 119 are positioned on the first panel 110 along the transverse axis D-D. As described in more detail below, the first and second magnets 117, 137 and the fifth and sixth magnets 119, 139 are aligned with each other so that magnetic attractive forces between the first and second magnets 117, 137 and between the fifth and sixth magnets 119, 139 facilitate the functionality of the clip of the clipboard 100.

Although two magnets are illustrated and described as being positioned on the second panel 130 along the transverse axis D-D in the exemplified embodiment, the invention is not to be so limited and a single magnet or more than two magnets may be used in other embodiments. Furthermore, as described above, the second, third, and sixth magnets 137, 138, 139 may not be magnets but may instead be any type of fastening element, such as any of the fastening elements described above. However the use of magnets may be beneficial for achieving a sleeker aesthetic appearance and for facilitating retention of items with the clipboard 100 as described herein. In certain embodiments the second magnet 137 may be spaced approximately 2 inches from the first side edge 135 of the second panel 130 and the third magnet 138 may be spaced approximately 2 inches from the second side edge 136 of the second panel 130. Furthermore, the sixth magnet 139 may be spaced approximately one inch from the bottom edge 133 of the second panel 130. Of course, other magnet locations are possible within the scope of the present invention as long as the functionality of the clipboard 100 and the alignment of the relevant magnets are adhered to as described herein below.

Figure 6:
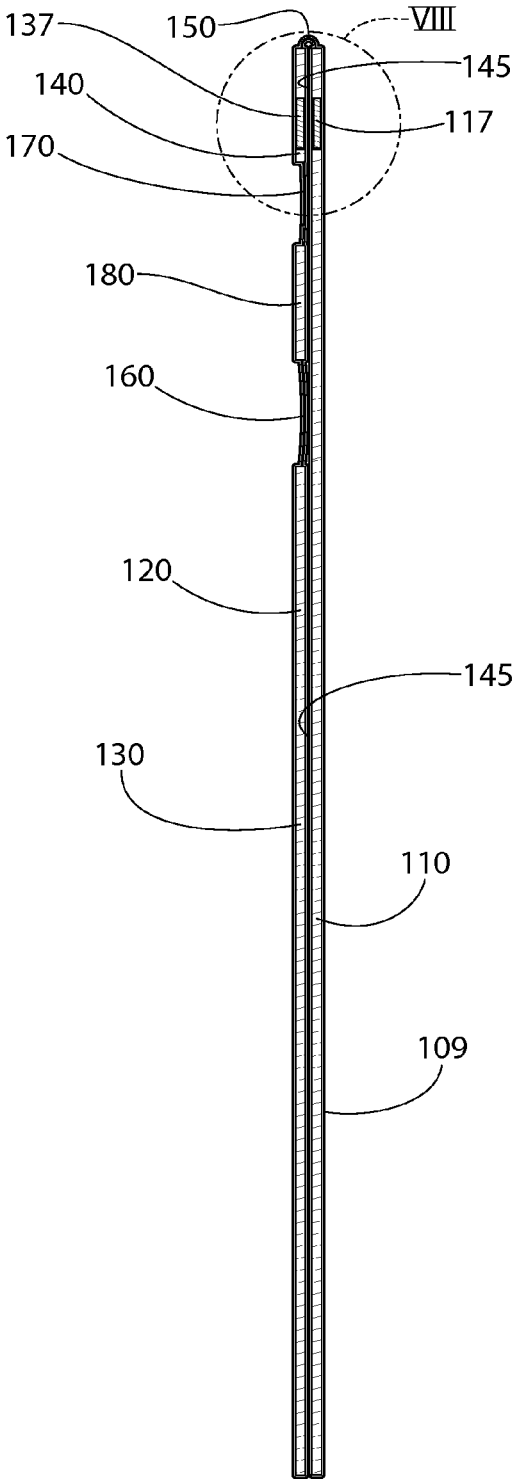
FIG. 6 is a cross-sectional view taken along line VI-VI of FIG. 2.
Figure 7:
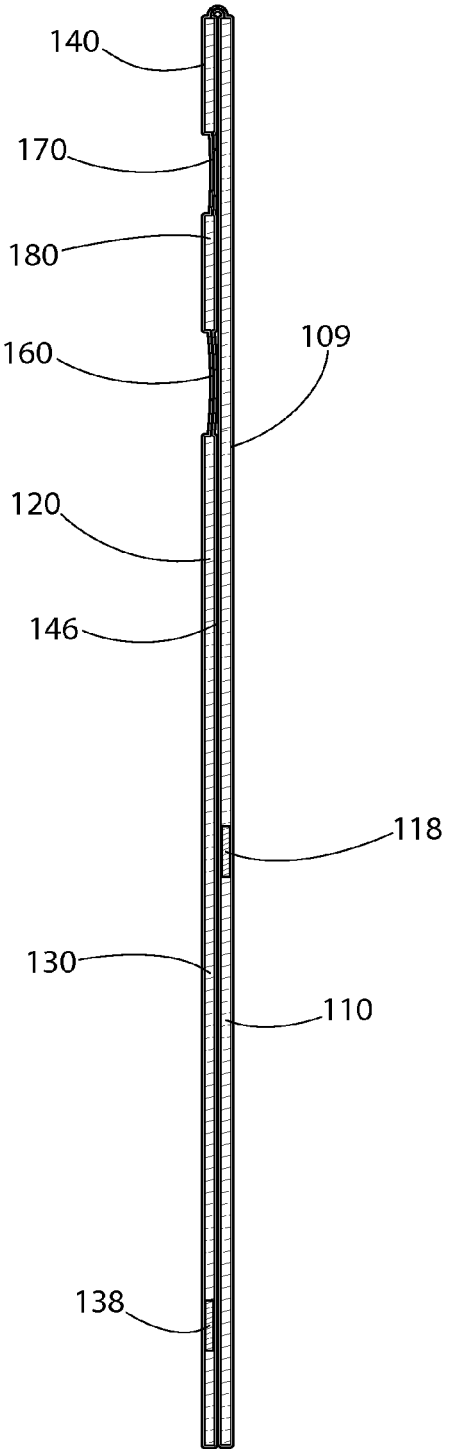
FIG. 7 is a cross-sectional view taken along line VII-VII of FIG. 2.
Figure 8:
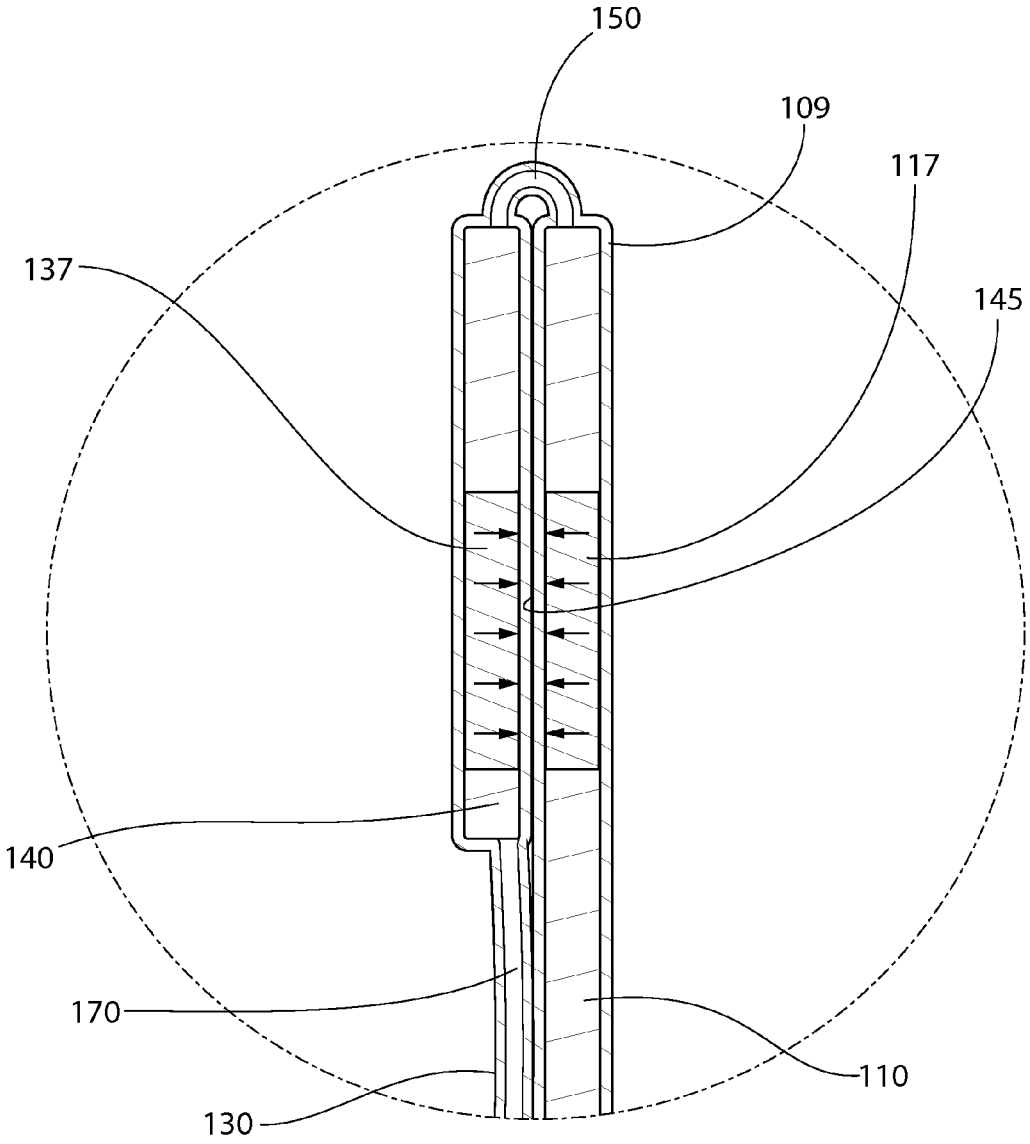
FIG. 8 is a close-up of area VIII of FIG. 6.

Referring to FIGS. 6-8 concurrently, the clipboard 100 will be described with the second panel 130 in the closed position. When the second panel 130 of the clipboard 100 is in the closed position, the second panel 130 overlies the entirety of the first panel 110 so that no portion of the front surface 111 of the first panel 110 is exposed. Of course, as noted above in alternative embodiments portions of the front surface 111 of the first panel 110 may be exposed when the second panel 130 is in the closed position. Furthermore, in the closed position the first section 140 of the clip portion 101 of the second panel 130 overlies the top portion 145 of the first panel 110 and the cover portion 120 of the second panel 130 overlies a bottom portion 146 of the first panel 110. When the second panel 130 is in the closed position the first magnet 117 of the first panel 110 is aligned with the second magnet 137 of the first section 140 of the clip portion 101 of the second panel 130. More specifically, the second magnet 137 of the first section 140 of the clip portion 101 directly overlies the first magnet 117 of the first panel 110 and opposite poles of the first and second magnets 117, 137 are adjacent to one another. Thus, if the negative pole of the first magnet 117 of the first panel 110 is facing the front surface 112 of the first panel 110 then the positive pole of the second magnet 137 of the first section 140 of the clip portion 101 is facing the rear surface 132 of the second panel 130. As a result, the first and second magnets 117, 137 are magnetically attracted to one another, thereby releasably securing the first section 140 of the clip portion 101 of the second panel 130 to the top portion 145 of the first panel 110. This magnetic attraction between the magnets is depicted in FIG. 8 with regard to the magnets 117, 137 (the same applies to the magnets 119, 139).

As described above, in the exemplified embodiment when the second panel 130 is in the closed position as illustrated in FIGS. 1-8, the first and second magnets 117, 137 (and also the fifth and sixth magnets 119, 139) are in direct alignment with one another so that an axis passing through either one of the first and second magnets 117, 137 (in the direction of the front and rear surfaces 111, 112 of the first panel 110 or the front and rear surfaces 131, 132 of the second panel 130) will also pass through the other one of the first and second magnets 117, 137. Although the first and second magnets 117, 137 are described herein as being aligned, the invention is not to be so limited and the first and second magnets 117, 137 need only be positioned sufficiently near to one another so that the first and second magnets 117, 137 are magnetically attracted to one another to releasably secure the first section 140 of the clip portion 101 of the second panel 130 to the top portion 145 of the first panel 110. Thus, in certain embodiments the first and second magnets 117, 137 may be slightly offset from one another while the magnet attractive forces between the two still sufficiently secures the first section 140 of the clip portion 101 of the second panel 130 to the top portion 145 of the first panel 110. Moreover, although the positioning of the first and second magnets 117, 137 is described herein above, in the exemplified embodiment the same description applies to the fifth magnet 119 of the first panel 110 and the sixth magnet 139 of the first section 140 of the clip portion 101 of the second panel 130.

Referring to FIG. 7, when the second panel 130 is in the closed position, the third magnet 138 of the second panel 130 is not aligned with the fourth magnet 118 of the first panel 110 or any other magnet on the first panel 110. However, the invention is not to be so limited and the first panel 110 may include an additional magnet that would be aligned with the third magnet 138 of the second panel 130 when the second panel 130 is in the closed position in order to releasably secure the cover portion 120 of the second panel 130 to the first panel 110. In the exemplified embodiment, the purpose of the third and fourth magnets 118, 138 is that they become aligned when the second panel 130 is transitioned into the open position so that the cover portion 120 of the second panel 130 is releasably secured to the first panel 110 to maintain the second panel 130 in the open position and to prevent the second panel 130 from flapping around.

Figure 9:
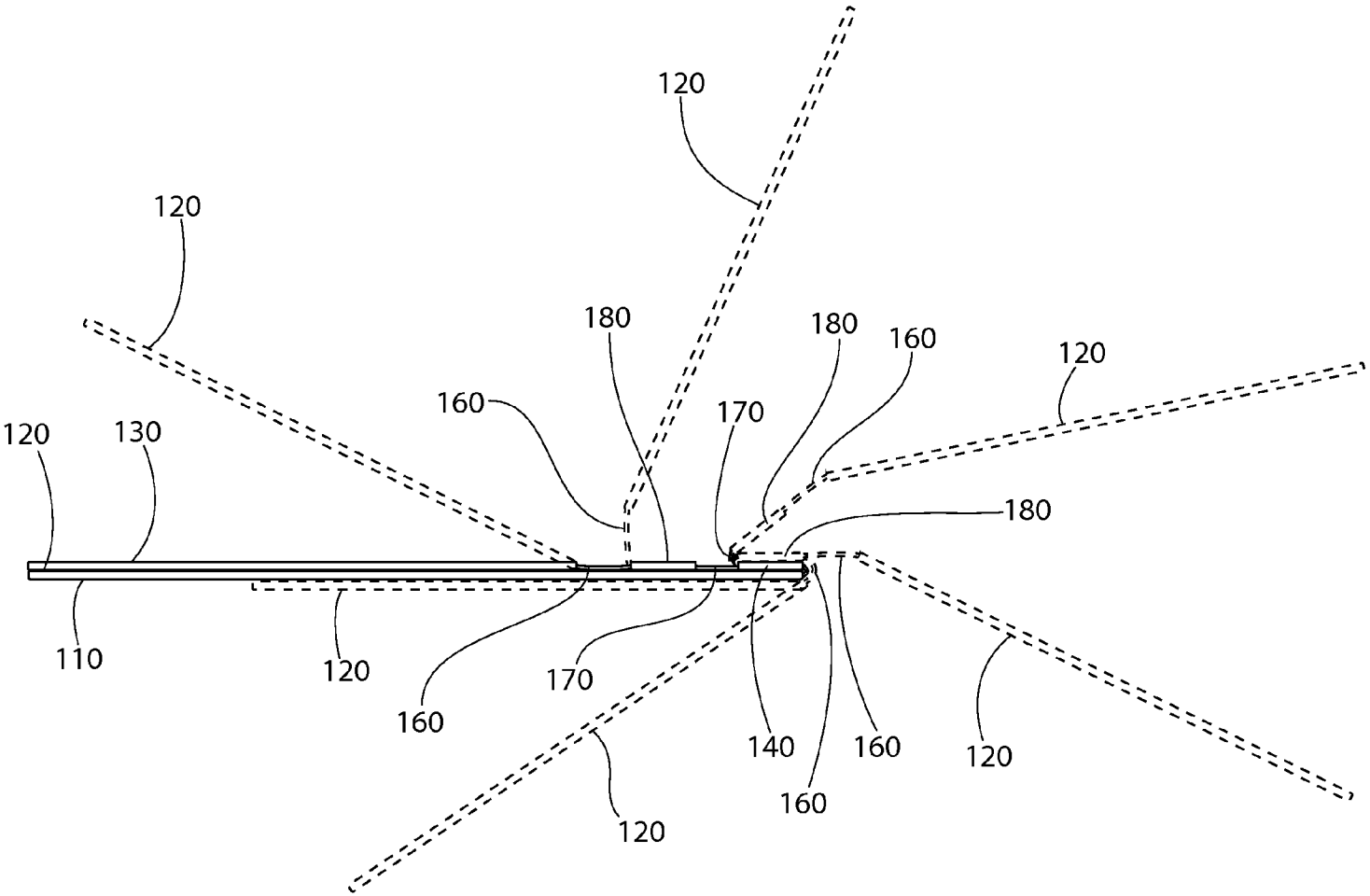
FIG. 9 is a side view of the clipboard of FIG. 1 illustrating the transition of the second panel between the closed position and an open position.
Figure 10:
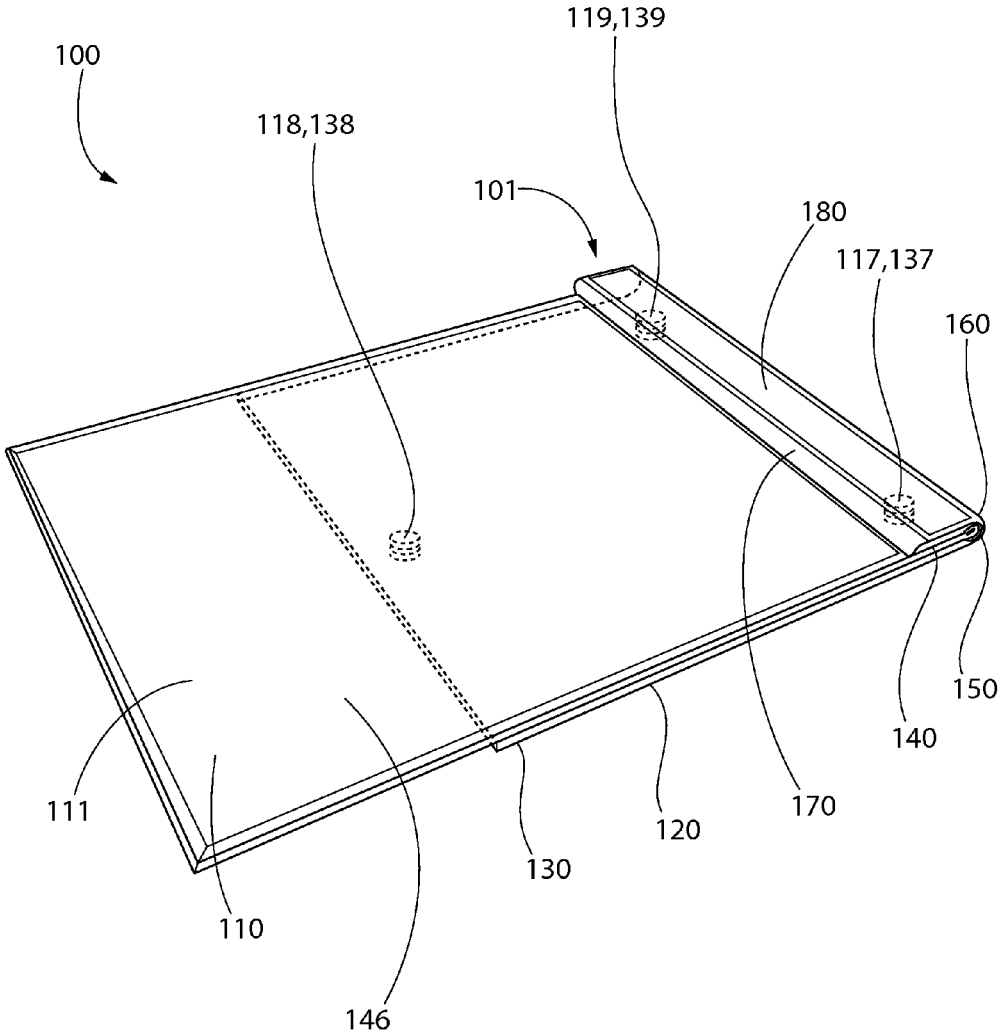
FIG. 10 is a front perspective view of the clipboard of FIG. 1, wherein the second panel of the clipboard is in the open position.

Referring to FIG. 9, as noted above the second panel 130 is adjustable between the closed position depicted in FIGS. 1-8 and the open position depicted in FIGS. 10-20. Specifically, in the closed position the second panel 130 overlies the first panel 110 so that no portion of the front surface 111 of the first panel 110 is exposed. Of course, in some embodiments some portions of the front surface 111 of the first panel 110 may be exposed even with the second panel 130 is in the closed position. To transition from the closed state to the open state, the second section 180 of the clip portion 101 of the second panel 130 is rotated about the third hinge 170 until the second section 180 of the clip portion 101 is adjacent to and overlies the first portion 140 of the clip portion 101. Next, the cover portion 120 of the second panel 130 is rotated about the second hinge 160 until the second hinge 160 wraps around the top edges 114, 134 of the first and second panels 110, 130 and overlies the first hinge 150. The cover portion 120 of the second panel 130 continues to be rotated about the second hinge 160 until the cover portion 120 of the second panel 130 is adjacent to the rear surface 112 of the first panel 110. At this point, the second panel 130 is in the open position and the front surface 111 of the first panel 110 (or portions thereof) is exposed. It should be appreciated that in certain embodiments the cover portion 120 can be rotated about the second hinge 160 first, follows by rotation of the second section 180 of the clip portion 101 about the third hinge 170.

Referring to FIGS. 10-18 concurrently, the structure and relationship between the components of the clipboard 100 will be described when the second panel 130 is in the open position. Specifically, when the second panel 130 is in the open position, the cover portion 120 of the second panel 130 is adjacent to the rear surface 112 of the first panel 110. More specifically, the first portion 102 of the front surface 131 of the second panel 130 (i.e., the portion of the front surface 131 of the second panel 130 that belongs to the cover portion 120 of the second panel 130) is adjacent to (and possibly in surface contact with) the rear surface 112 of the first panel 110. Furthermore, the second section 180 of the clip portion 101 of the second panel 130 overlies the first section 140 of the clip portion 101 of the second panel 130. More specifically, the second portion 103 of the front surface 131 of the second panel 130, which belongs to the second section 180 of the clip portion 101 of the second panel 130, is adjacent to (and possibly in surface contact with) the third portion 104 of the front surface 131 of the second panel 130, which belongs to the first section 140 of the clip portion 101 of the second panel 130. Furthermore, in the open position the second hinge 160 of the second panel 130 wraps around the top ends 114, 134 of the first and second panels 110, 130 and overlies/covers the first hinge 150.

Finally, in the open position the clip portion 101 of the second panel 130 remains in the same position as described above with regard to the closed position in which the clip portion 101 of the second panel 130 overlies the first panel 110, and more specifically the top portion 145 of the first panel 110. Thus, even when the second panel 130 is adjusted or transitioned into the open position, the clip portion 101 remains positioned atop of the first panel 110. As a result, this clip portion 101 of the second panel 130 forms a clip for the clipboard 100 and retains items between the clip portion 101 and the first panel 110 when the second panel 130 is in both the open and closed positions. It should also be appreciated that the second hinge 170 forms a front edge of the clip of the clipboard 100 that is formed by the clip portion 101 of the second panel 130. When the second panel 130 is in the open position, the bottom portion 146 of the first panel 110 (specifically of the front surface 111 of the first panel 110) is exposed due to the cover portion 120 of the second panel 130 being located at the rear surface 112 of the front panel 110. Furthermore, when the second panel 130 is in the open position, the clip portion 101 can also be adjusted between a closed position and an open position, which will be described in more detail below with regard to FIGS. 19 and 20.

The positioning and relationship between the first and second magnets 117, 137 (and also the fifth and sixth magnets 119, 139 in the exemplified embodiment) further facilitate the use of the clip portion 101 as a clip for the clipboard 100. Specifically, when the second panel 130 is in the open position with the cover portion 120 of the second panel 130 adjacent to the rear surface 112 of the first panel 110, the first and second magnets 117, 137 (and also the fifth and sixth magnets 119, 139) are still aligned with one another so as to be magnetically attracted to one another. As a result, when the second panel 130 is in the open position, the clip portion 101 of the second panel 130 (comprising the first and second sections 140, 180 which are overlying one another) is magnetically adhered, or releasably secured via the magnetic attractive forces between the first and second magnets 117, 137, to the front surface 111 of the first panel 110.

When the second panel 130 is in the open position, the bottom portion 146 of the front surface 111 of the first panel 110 is exposed. Thus, if the clip portion 101 is being used to retain paper or other items in the clipboard 100, the paper or other items will also be exposed. Specifically, top edges of the paper or other items will be trapped or sandwiched between the clip portion 101 of the second panel 130 and the first panel 110, and the portions of the paper or other items that are not sandwiched between the clip portion 101 and the first panel 110 will be exposed. As a result, if the item is paper a user can display the paper and write on the paper using the first panel 110 as a rigid writing surface.

Moreover, when the second panel 130 is in the open position, the third magnet 138 of the cover portion 120 of the second panel 130 is aligned with the fourth magnet 118 of the first panel 110. As noted above, when the second panel 130 is in the closed position, the third and fourth magnets 138, 118 are not aligned because the third and fourth magnets 138, 118 are transversely offset from one another. Thus, although both of the third and fourth magnets 138, 118 are positioned on the longitudinal axis A-A, no magnetic attraction occurs between the third and fourth magnets 138, 118 when the second panel 130 is in the closed position. However, due to all of the folding that occurs in transitioning between the closed and open positions (and due to the fact that the first and second sections 140, 180 of the clip portion 101 remain adjacent to the front surface 111 of the first panel 110), when the second panel 130 is in the open position the third and fourth magnets 138, 118 are aligned and magnetically attracted to one another (because opposite poles of the third and fourth magnets 138, 118 are facing one another). Thus, due to the magnetic attractive forces between the third and fourth magnets 138, 118 when the second panel 130 is in the open position, the cover portion 120 of the second panel 130 is releasably secured to the first panel 110. These magnetic attractive forces prevent the cover portion 120 of the second panel 130 from flopping or flapping around when in the open position. Thus; when the second panel 130 is in the open position, it remains in that position until user force greater than the magnetic attractive force between the third and fourth magnets 118, 138 is applied to the cover portion 120 of the second panel 130 and the first panel 110 in a direction opposite to the direction of the magnetic attractive force between the third and fourth magnets 118, 138.

Although the third and fourth magnets 118, 138 are described herein as magnets, the invention is not to be so limited. The third and fourth magnets 118, 138 may be any fastening element capable of releasably securing the cover portion 120 of the second panel 130 to the rear surface 112 of the first panel 110 when the second panel 130 is in the open position. Specifically, hook-and-loop fasteners that align with each other when the second panel 130 is in the open position can be used instead of the magnets to releasably secure the cover portion 120 of the second panel 130 to the first panel 110. Alternatively, adhesive can be positioned on one of the rear surface 112 of the first panel 110 and the front surface 131 of the cover portion 120 of the second panel 130. Further still, in some embodiments the third and fourth magnets 118, 138 may be omitted and there may be no feature for releasably securing the cover portion 120 of the second panel 130 to the first panel 110 when the second panel 130 is in the open position. Thus, although the figures provide illustrations of one particular embodiment, other embodiments are possible within the scope of the present invention.

In certain embodiments, it may be desirable to include indicia, such as a person's initials, a company logo, or the like, on the clipboard. Such indicia may be included on any one of the front and rear surfaces 131, 132 of the second panel 130 or the front and rear surfaces 111, 112 of the first panel 110. Alternatively, the indicia may be located on the rear surface 132 of the second panel 130 within the second section 180 of the second panel 130 because when the second panel 130 is in the open position, the rear surface 132 of the second portion 180 of the second panel 130 forms the exposed outer surface of the clip/clip portion 101. Thus, when so positioned, indicia such as a user's initials, a company logo, a character, or any other desired indicia can be visible when the second panel 130 is in the open position.

When in the open position, the first and second hinges 150, 160 provides a location that a pen or other writing device can be coupled to the clipboard by inserting a clip of the pen into the space created by the first and second hinges 150, 160. Furthermore, in the closed position the first hinge 150 provides such a location for attachment of a pen or other writing device.

Although the invention has been described herein whereby the second panel 130 is magnetically or otherwise adhered to the first panel 110 when the second panel 130 is in the open position, the invention is not to be so limited. In certain embodiments, the second panel 130 may be used as a stand to hold the clipboard 100 upright. Specifically, in the open position the second panel 130 may be spaced from the first panel 110 and the bottom edges 113, 133 of the first and second panels 110, 130 may both be positioned atop of a horizontal surface (such as a desk or floor) to support the clipboard 100 in an upright orientation. In this manner, the materials retained by the clipboard 100 can be displayed without a user needing to physically hold the clipboard 100. Furthermore, to assist in maintaining the clipboard 100 in the upright orientation, removable rubber elements may be coupled to each of the corners of the clipboard 100 to prevent the clipboard 100 from sliding on a desk or other horizontal surface upon which it is being supported. In an alternative embodiment, the corners could be dipped in a rubber material (or overmolded with a rubber material, such as via an injection molding process) to achieve this added stability without necessitating separate rubber corner pieces.

Figure 19:
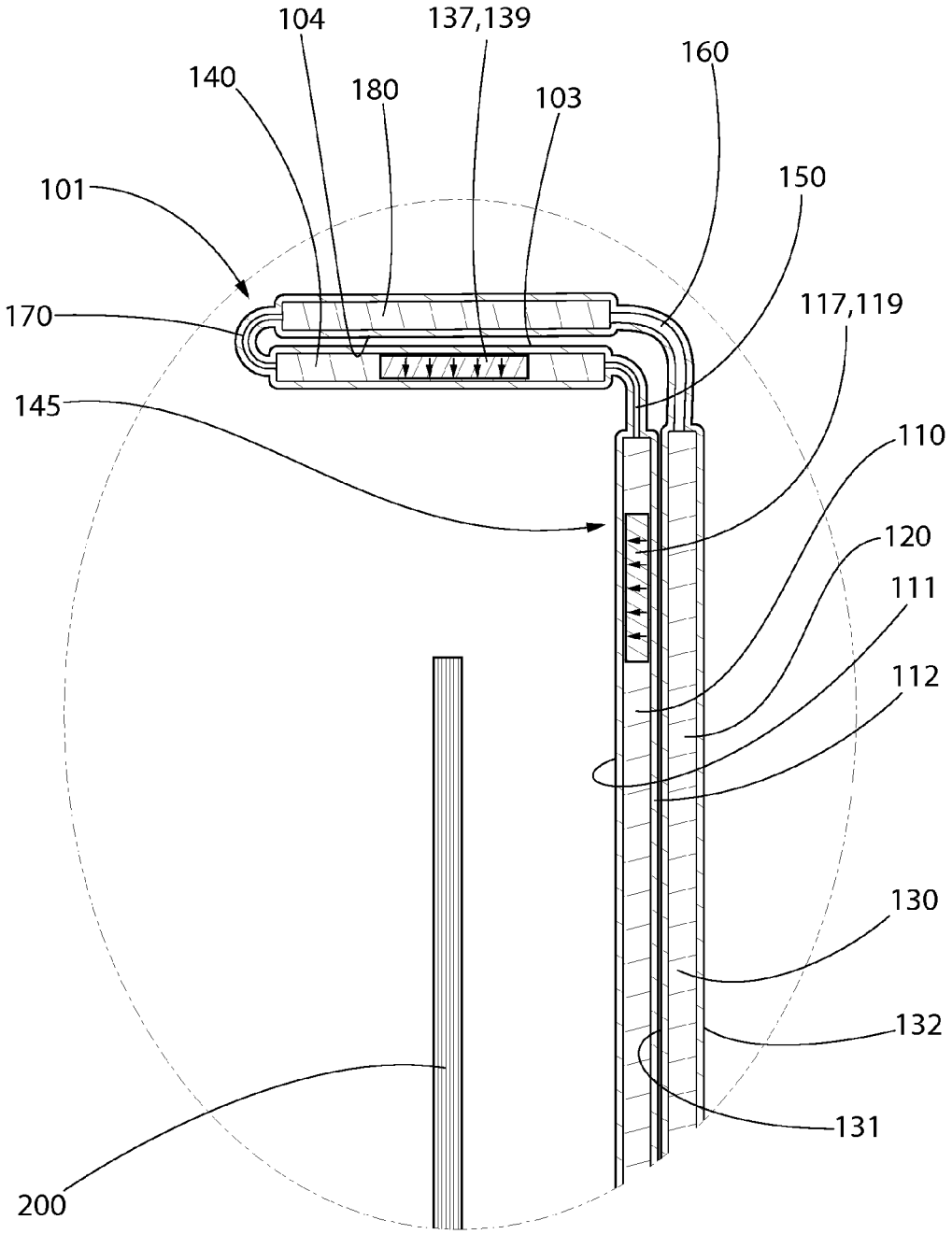
FIG. 19 is a close-up cross-sectional schematic view illustrating a clip of the clipboard in an open position.
Figure 20:
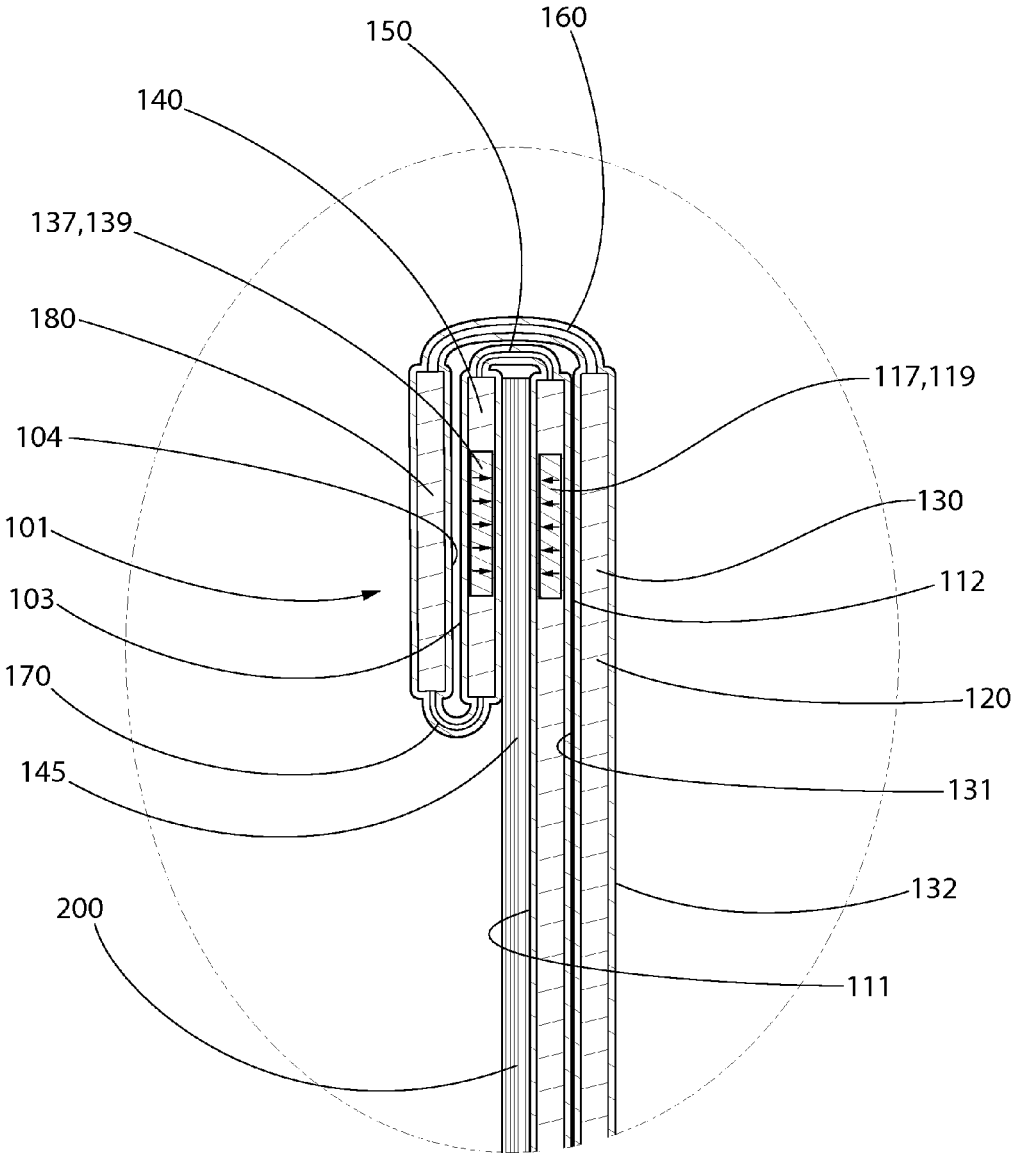
FIG. 20 is a close-up cross-sectional schematic view illustrating the clip of the clipboard in a closed position and retaining an item.
Figure 21:
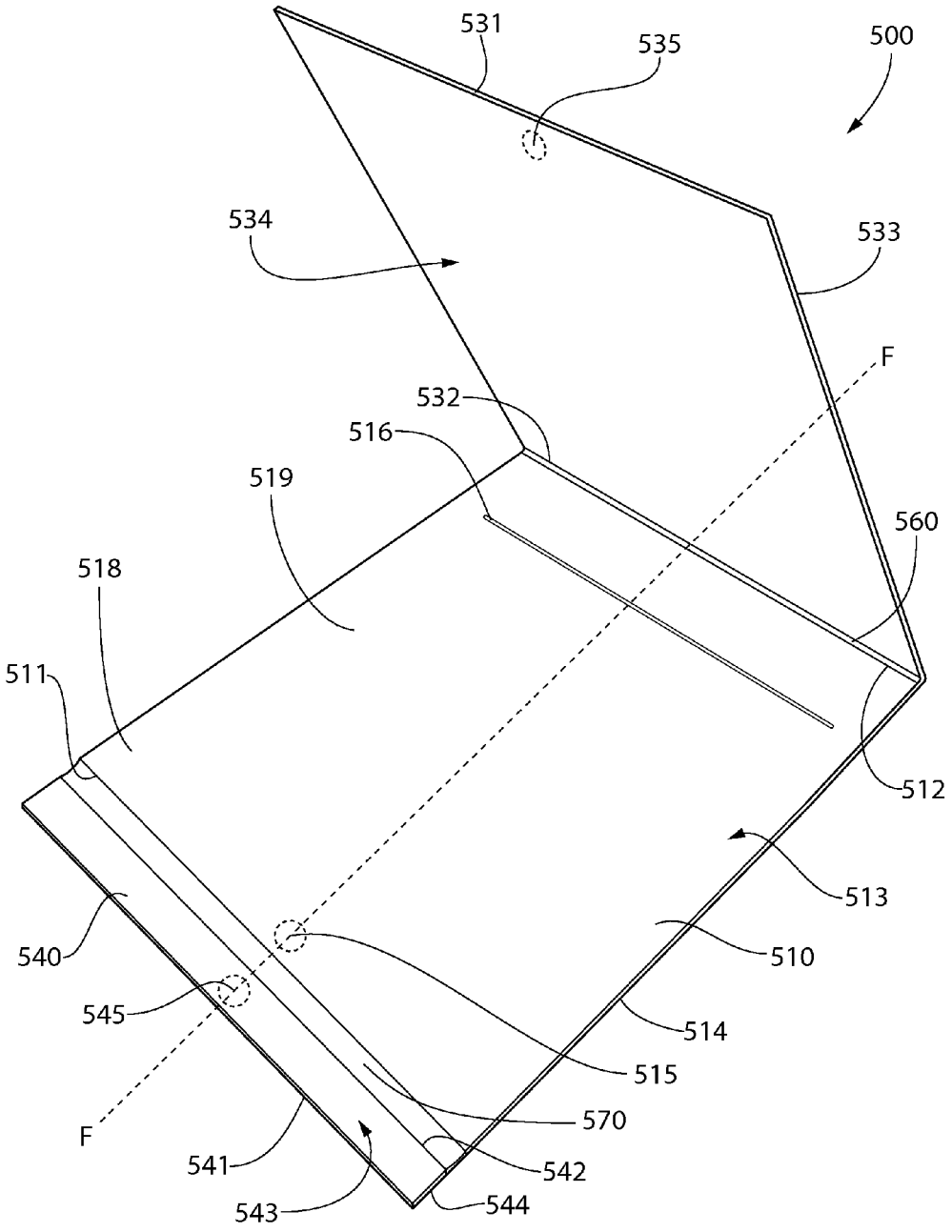
FIG. 21 is a front perspective view of a clipboard in accordance with a second embodiment of the present invention, wherein the clipboard is in an open state.
Figure 22:
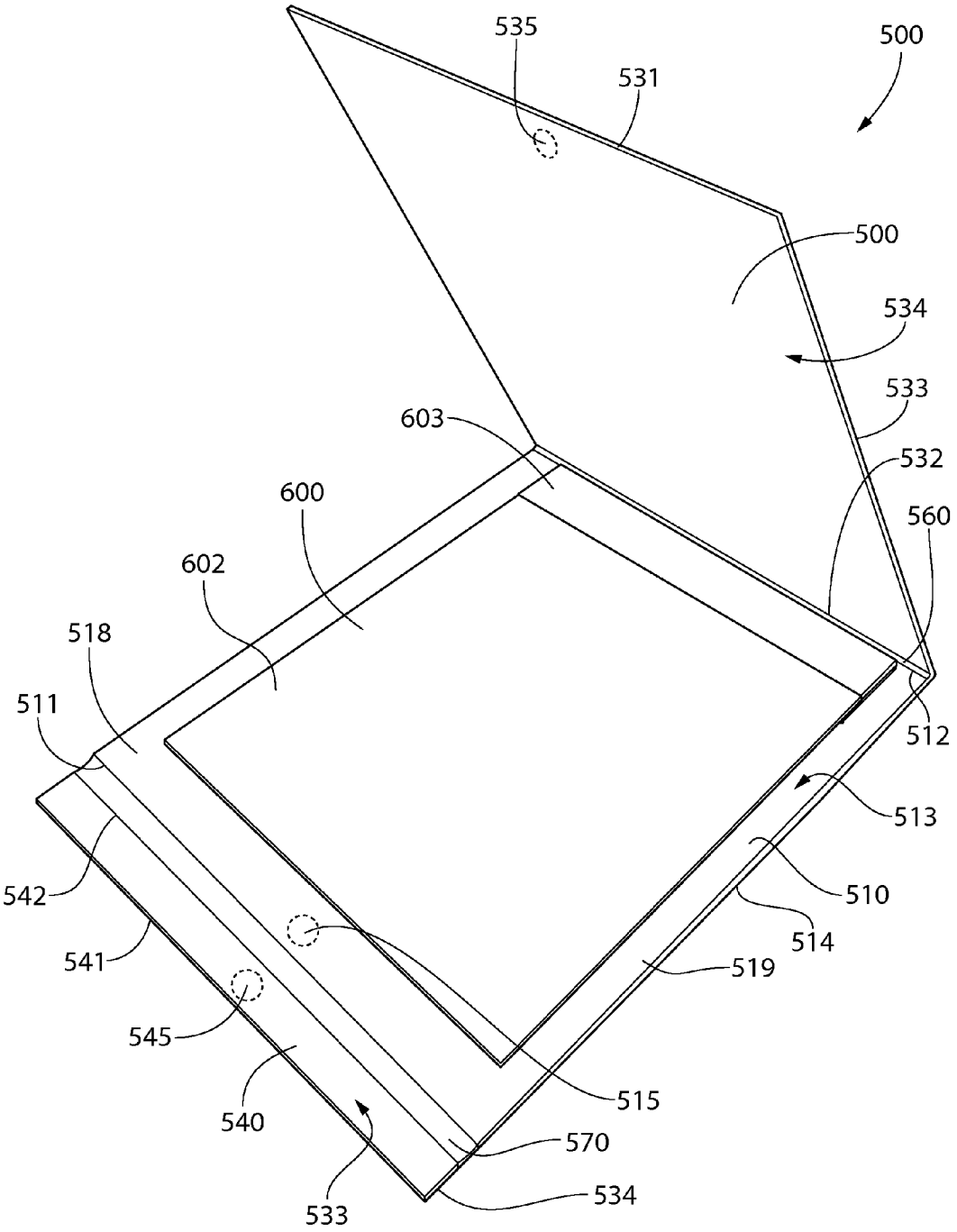
FIG. 22 is a front perspective view of the clipboard of FIG. 21 with a pad of paper retained by the clipboard.
Figure 23:
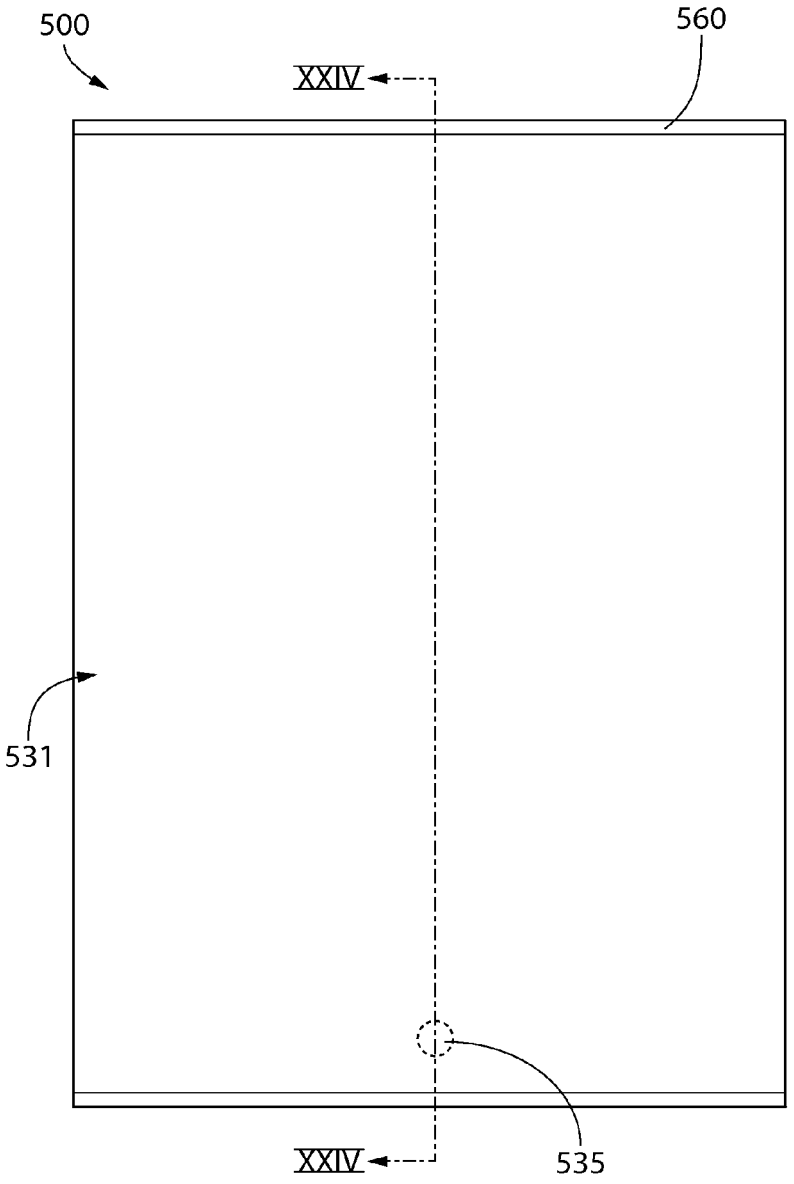
FIG. 23 is a front view of the clipboard of FIG. 22 in a closed state.

Referring to FIGS. 19 and 20, the functionality of the clip portion 101 of the clipboard 100 will be further described. When the second panel 130 is transitioned into the open position, the clip portion 101 is in a closed position in which the clip portion 101 is overlying and releasably secured to the top portion 145 of the front surface 111 of the first panel 110 via the magnetic attractive forces between the first and second magnets 117, 137 and the fifth and sixth magnets 119, 139. In this position, an item, such as paper or the like, can be retained between the clip portion 101 of the second panel 130 and the first panel 110. However, using force to overcome the magnetic attractive force between the first and second magnets 117, 137 (and/or the fifth and sixth magnets 119, 139 or any other magnets or other fastener elements), a user can pull the clip portion 101 of the second panel 130 in a direction away from the front surface 111 of the first panel 110. Specifically, by pulling the clip portion 101 of the second panel 130 in a direction away from the front surface 111 of the first panel 110 with sufficient force to overcome the magnetic attractive forces noted above, the clip portion 101 transitions from the closed position to an open position (see FIG. 19). During transition from the closed position to the open position, the clip portion 101 rotates about each of the first and second hinges 150, 160 simultaneously.

In the open position, the clip portion 101 of the second panel 130 is spaced from the front surface 111 of the first panel 110 to expose the front surface 111 of the top portion 145 of the first panel 110. As a result, in this position items that were previously sandwiched between the clip portion 101 and the first panel 110 can be removed from the clipboard 100 and new items can be placed into position for being retained by the clip portion 101 of the clipboard 100. Specifically, FIG. 19 illustrates the clip portion 101 in the open position and a stack of paper 200 being inserted onto the front surface 111 of the first panel 110 of the clipboard 100. The stack of paper 200 will be positioned onto the clipboard 100 so as to be in contact with the front surface 111 of the first panel 110 within the top portion 145 of the first panel 111. After the stack of paper 200 is properly positioned, the clip portion 101 of the second panel 130 is rotated back into the closed position by pressing the clip portion 101 of the second panel 130 in the direction of the front surface 111 of the first panel 110 until the clip portion 101 of the second panel 130 contacts the stack of paper 200.

At such time, the stack of paper 200 is sandwiched between the clip portion 101 of the second panel 130 and the front surface 111 of the first panel 110. Furthermore, due to magnetic attraction forces as described herein above the first and second magnets 117, 137 (and the fifth and sixth magnets 119, 139 and any other corresponding magnets or fastening elements) pull the clip portion 101 of the second panel 130 towards the first panel 110 with sufficient magnetic force to retain the stack of paper 200 in position (see FIG. 20).

Because the clip of the clipboard 100 is built into the second panel 130 of the clipboard 100, there is no bulky clip protruding from the first panel 110 for item retention. Thus, the clipboard 100 has a small and thin profile regardless of whether the second panel 130 is in the open or closed positions. Furthermore, the lack of a bulky clip also permits a plurality of the clipboards 100 to be stacked atop of one another. When stacked atop of one another, the magnets 117, 119 of a top one of the clipboards 100 will adhere via magnetic attraction to the magnets 137, 139 of the clipboard 100 directly below the top one of the clipboards 100 to perfectly align the clipboards 100 during stacking. Furthermore, due to the magnets 117, 119 on the first panel 110, the clipboard 100 can be magnetically adhered to a metal surface such as a refrigerator or metal cabinet with the rear surface 112 of the first panel 110 of the clipboard 100 facing the metal surface. Alternatively, due to the magnets 137, 139 the clipboard can be magnetically adhered to the metal surface with the front surface 131 of the second panel 130 facing the metal surface.

Figure 12:
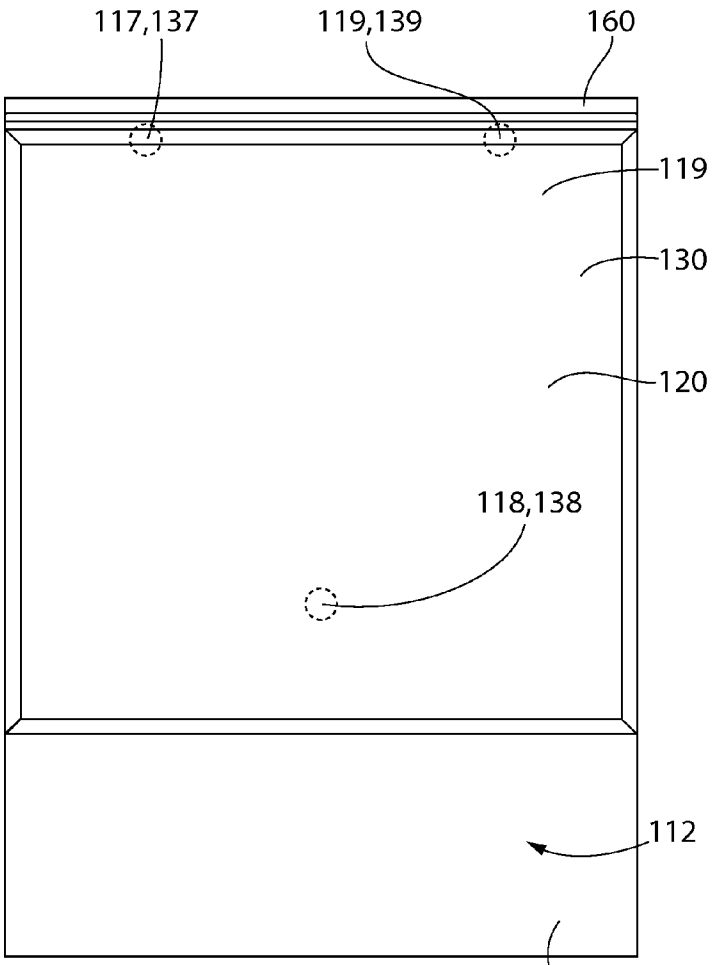
FIG. 12 is a rear view of the clipboard of FIG. 10.
Figure 11:
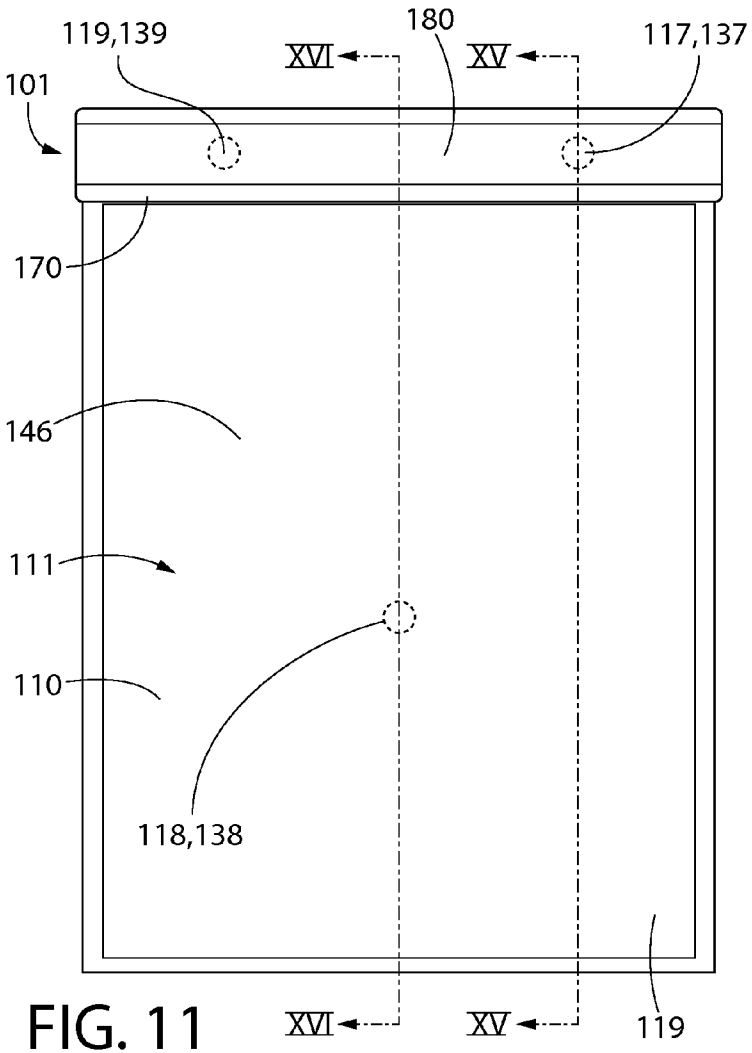
FIG. 11 is a front view of the clipboard of FIG. 10.
Figure 13:
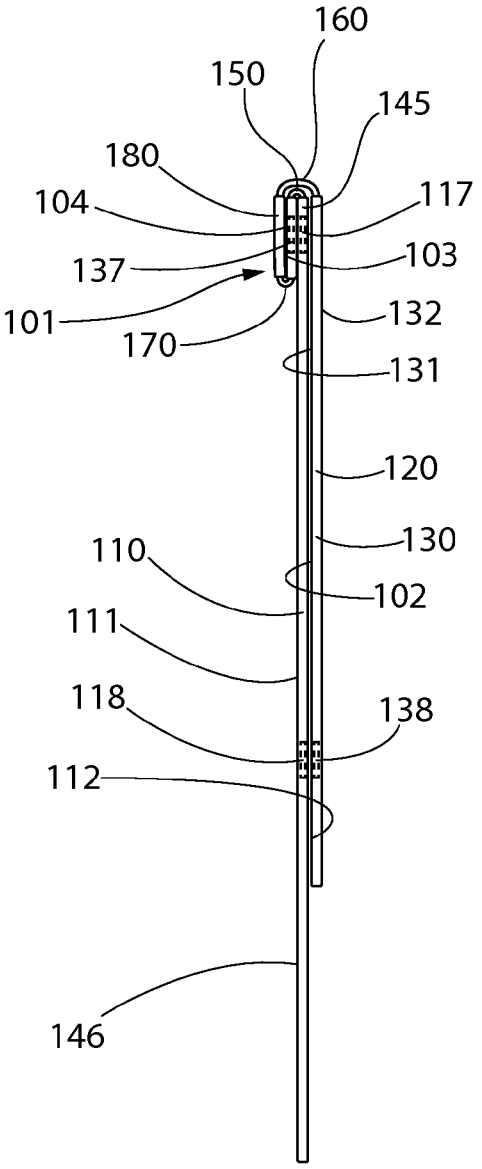
FIG. 13 is a right-side view of the clipboard of FIG. 10.
Figure 14:
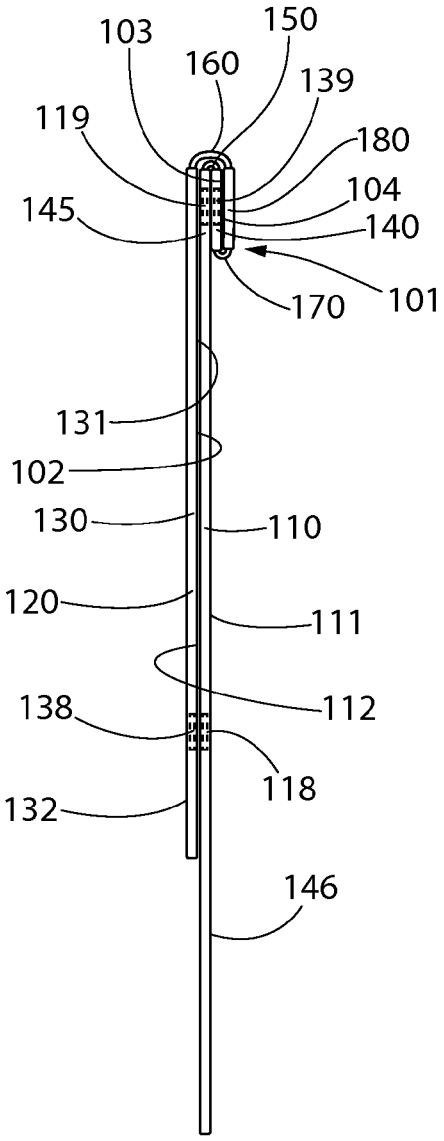
FIG. 14 is a left-side view of the clipboard of FIG. 10.
Figure 15:
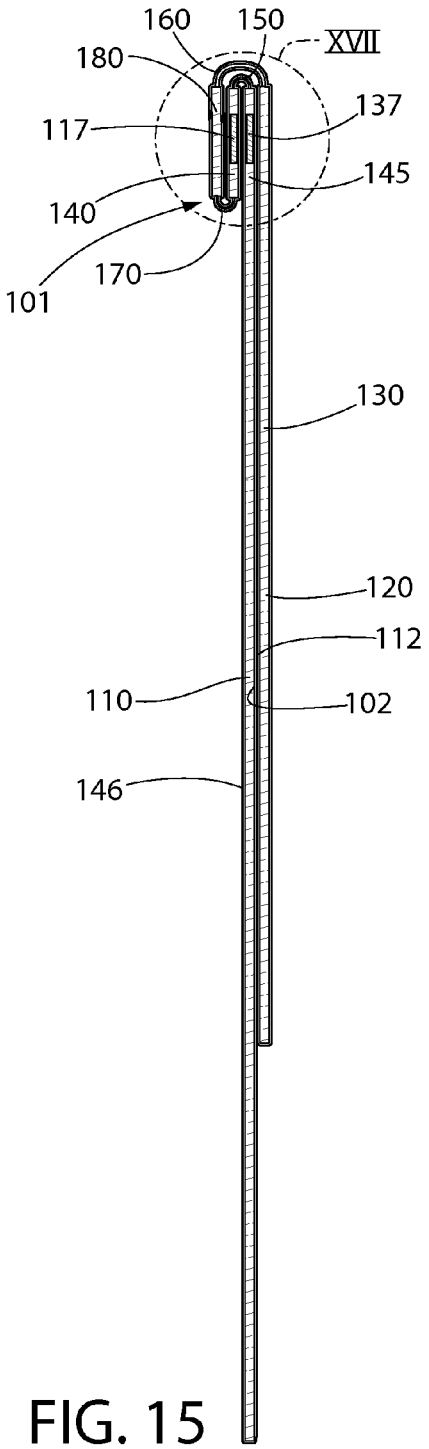
FIG. 15 is a cross-sectional view taken along line XV-XV of FIG. 11.
Figure 16:
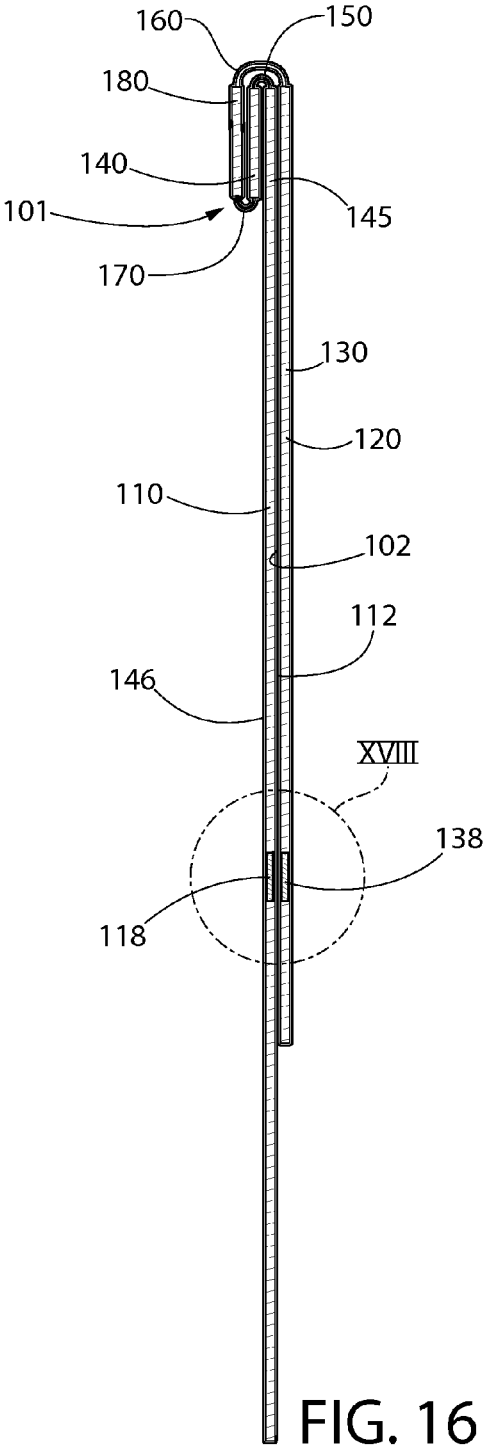
FIG. 16 is a cross-sectional view taken along line XVI-XVI of FIG. 11.
Figure 17:
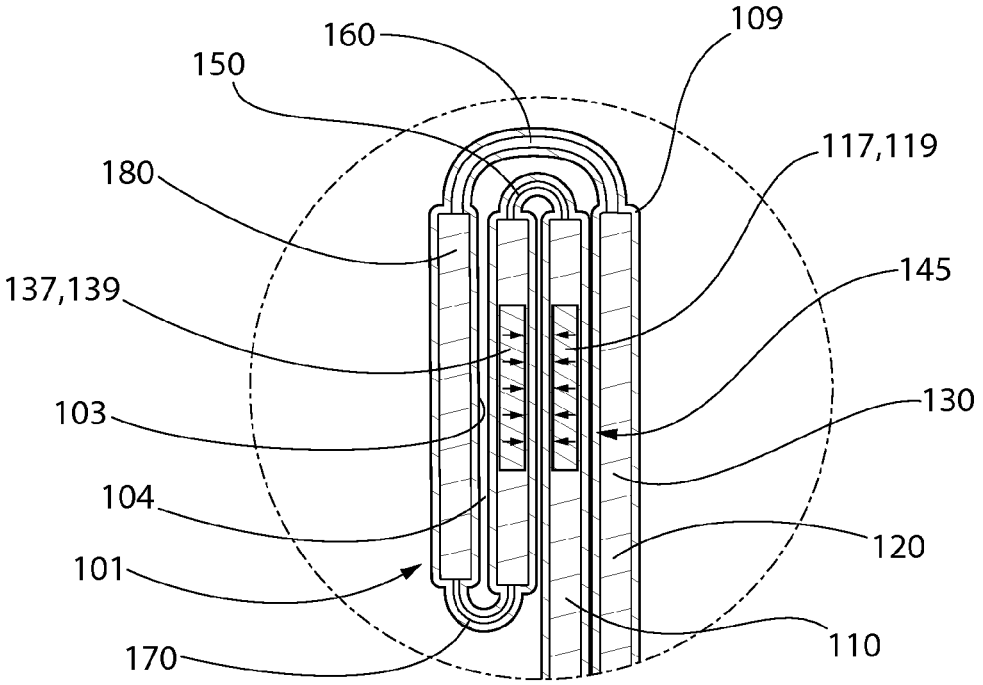
FIG. 17 is a close-up view of area XVII of FIG. 15.
Figure 18:
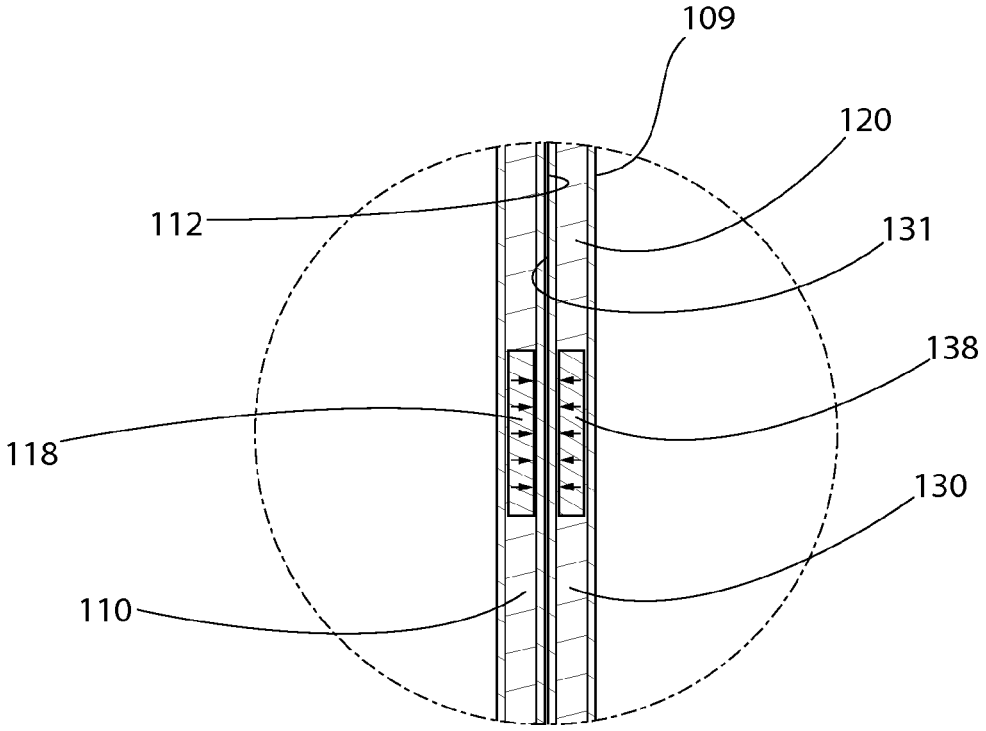
FIG. 18 is a close-up view of area XVIII of FIG. 16.

Furthermore, in the exemplified embodiment the front surface 111 of the first panel 110 and the rear surface 132 of the second panel 130 are lined with paper 119 (see FIGS. 11 and 12). The paper can be any color and may include pattering thereon. In alternate embodiments, at least the front surface 111 of the first panel 110 may be lined with chalkboard paint so that a user can write directly on the front surface 111 of the first panel 110 with chalk. In another embodiment, at least the front surface 111 of the first panel 110 may be lined with dry erase white board material so that a user can write on the front surface 111 of the first panel 110 with a dry erase marker. In such an embodiment, the clipboard 100 may be sold as a kit with a dry erase marker, and the dry erase marker may comprise a magnet so that the dry erase marker can be magnetically adhered to the clipboard 100 via one of the magnets 117-119, 137-139. With the dry erase board or chalkboard material, when the second panel 130 is in the open position and the front surface 111 of the first panel 110 is exposed, a user can directly write onto the front surface 111 of the first panel 110 to give a presentation or for any other desired reason.

Furthermore, in yet another embodiment a slit may be formed into the front surface 111 of the first panel 110 to enable the back cardboard liner of a paper pad (legal pad, notepad, drawing pad, etc.) to be inserted and held in place. Specifically, the cardboard liner of a paper pad may be able to be inserted into a slit in the first panel 110 so that the cardboard liner of the paper pad is positioned between the front and rear surfaces 111, 112 of the first panel 110 and the paper of the paper pad is positioned atop of the front surface 111 of the first panel 110. This can be useful if for example, the strength of the magnets is insufficient to retain the entire paper pad on its own or if it is simply desired to hide away from view the cardboard liner of the paper pad.

In the exemplified embodiment, when the second panel 130 is in the closed position, there is no magnet or other fastening element releasably securing the cover portion 120 of the second panel 130 to the first panel 110. However, the invention is not to be so limited and magnets on the cover portion 120 and the first panel 110 may be aligned and magnetically attracted to one another when the second panel 130 is in the closed position to achieve this purpose. Alternatively, other fastening elements such as those described above can be used to releasably secure the cover portion 120 of the second panel 130 to the first panel 110 when the second panel 130 is in the closed position. In another embodiment, the clipboard 100 may comprise an elastic band or strap that can be secured around the first and second panels 110, 130 to maintain the cover portion 120 closed onto the first panel 110. Such an elastic band may be fixedly coupled to the clipboard 100 or a separate component.

As an alternative to traditional clipboard uses, the clipboard 100 of the present invention can be used as a cutting board, chalk board, dry erase white board with or without permanent lines depicting a basketball court or the like for use by a basketball coach. Furthermore, additional straps, clips, or the like may be included with the clipboard 100 for the attachment of tablets, smartphones, or the like to the clipboard 100. Finally, additional flaps, panels, or the like may be incorporated into the clipboard 100 and attached to the existing first and/or second panels 100, 200 to enhance the upright standing of the clipboard 100.

Referring now to FIGS. 21-26 concurrently, a clipboard 500 will be described in accordance with another embodiment of the present invention. It should be appreciated that in the interest of brevity, the details of certain components of the clipboard 500 will be omitted, it being appreciated that the description of a similar component of the clipboard 100 applies. For example, the clipboard 500 will be described as having magnets, and it should be appreciated that the details with regard to the shape and the like of the magnets of the clipboard 100 applies, and also that the magnets of the clipboard 500 can be replaced by other fastening elements as described above with regard to the magnets of the clipboard 100. Thus, although the clipboard 500 is described herein as another embodiment of the present invention, the description of certain features of the clipboard 100 is applicable to the clipboard 500 as would be readily appreciated by persons of ordinary skill in the art.

The clipboard 500 generally comprises a first panel 510, a second panel 530, and a third panel 540. The first panel 510 extends along a longitudinal axis F-F from a bottom end 511 to a top end 512. Furthermore, the first panel 510 comprises a front surface 513, a rear surface 514, and a first magnet 515. In certain embodiments, the first panel 510 is a rigid panel as the term rigid has been defined herein above. Furthermore, the first panel 510 is a flat and planar structure such that each of the front and rear surfaces 513, 514 of the first panel 510 is flat and planar.

Figure 24:
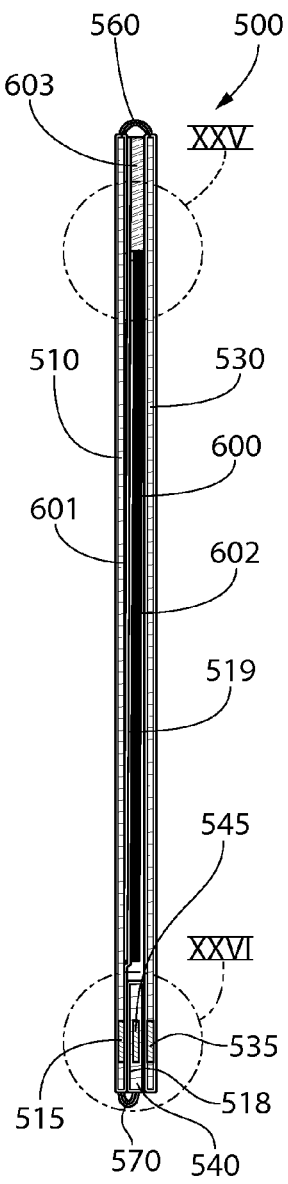
FIG. 24 is a cross-sectional view taken along line XXIV-XXIV of FIG. 23.
Figure 25:
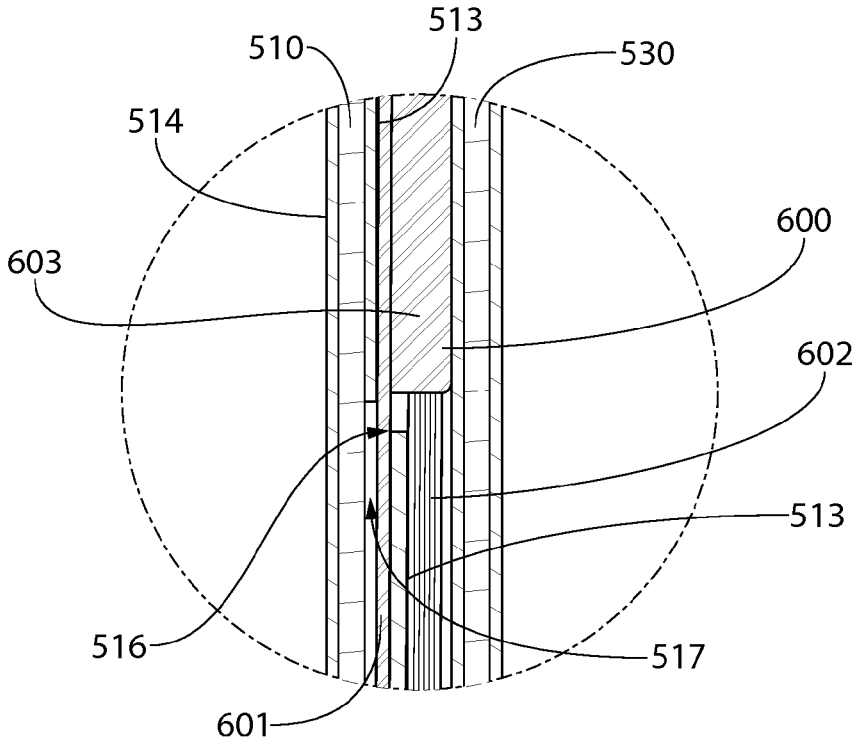
FIG. 25 is a close-up view of area XXV of FIG. 24.
Figure 26:
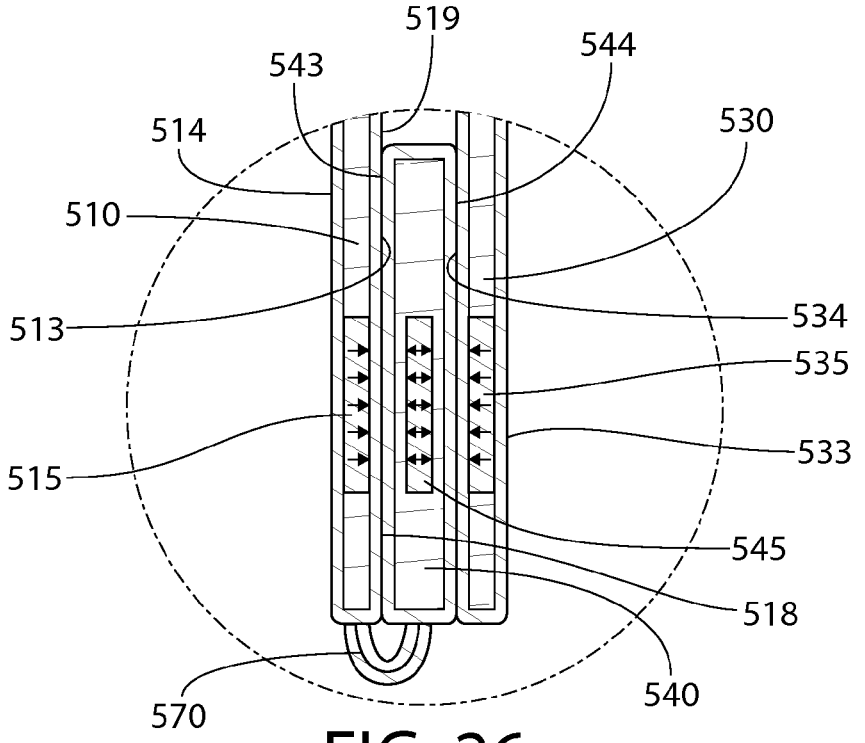
FIG. 26 is a close-up view of area XXVI of FIG. 24.

The first panel 510 further comprises a slit 516 formed therein. The slit 516 is elongated in a direction transverse to the longitudinal axis F-F, and thus the slit 516 extends horizontally along the first panel 510 between the opposing lateral sides of the first panel 510. The slit 516 forms a passageway into a space 517 defined between the front and rear surfaces 513, 514 of the first panel 510 (see FIG. 25). In certain embodiments, the clipboard 500 may be configured to retain a notepad or legal pad 600 thereon. Conventional legal pads 600 comprise a cardboard backer panel 601 and a plurality of sheets of paper 602. The slit 516 preferably has a length that is equal to or greater than a width of the cardboard backer panel 601 (which has a conventional size of 8.5 inches, but may be larger or smaller). Thus, in use the cardboard backer panel 601 of the legal pad 600 can be inserted through the slit 516 and into the space 517 defined between the front and rear surfaces 513, 514 of the first panel 510. This is best illustrated in FIGS. 24 and 25.

The second panel 530 extends from a bottom end 531 to a top end 532. Furthermore, the second panel 530 comprises a front surface 533, a rear surface 534, and a second magnet 535. In certain embodiments, the second panel 530 is a rigid panel as the term rigid has been defined herein above. Furthermore, the second panel 530 is a flat and planar structure such that each of the front and rear surfaces 533, 534 of the second panel 530 is flat and planar. The first panel 510 has a length measured between the bottom and top ends 511, 512 of the first panel 510 and the second panel 530 has a length measured between the bottom and top ends 531, 532 of the second panel 530. In the exemplified embodiment, a ratio of the length of the first panel 510 to the length of the second panel 530 is approximately 1:1. However, other length ratios are possible in other embodiments and the invention is not to be so limited in all embodiments.

The first and second panels 510, 530 are coupled together by a first hinge 560 that connects the top end 512 of the first panel 510 to the top end 532 of the second panel 530. In the exemplified embodiment, the first hinge 560 is formed by a portion of the clipboard 500 that has a reduced thickness relative to the top ends 512, 532 of the first and second panels 510, 530. Of course, the invention is not to be so limited in all embodiments and the first hinge 560 may be formed in any other manner such as those described herein above with regard to the hinges of the clipboard 100.

The third panel 540 extends from a bottom end 541 to a top end 542. The third panel 540 comprises a front surface 543, a rear surface 544, and third magnet 545. The third panel 540 is coupled to the bottom end 511 of the first panel 510 by a second hinge 570. More specifically, the second hinge 570 couples the top end 542 of the third panel 540 to the bottom end 511 of the first panel 510. The third panel 540 has a length measured from the bottom end 541 of the third panel 540 to the top end 542 of the third panel 540. Although the first, second, and third panels 510, 530, 540 are each illustrated and described herein with a single magnet, each can be multiple magnets in other embodiments. Furthermore, the magnets can be replaced by other fastening elements such as has been described herein above with regard to the clipboard 100.

In certain embodiments, a ratio of the length of the first panel 510 (and also of the length of the second panel 530) to the length of the third panel 540 is between 4:1 and 7:1, and more specifically between 5:1 and 6:1. Of course, the invention is not to be so limited in all embodiments and the ratio of the length of the first and second panels 510, 530 to the length of the third panel 540 can be outside of the above-noted range in some embodiments. However, the range noted above enables the third panel 540 to properly function as a hinge for the clipboard 500 as desired. Thus, the third panel 540 is an alternative mechanism for retaining items such as the legal pad 600 within the clipboard 500 when the slit 516 described above is not used or is omitted.

The clipboard 500 is alterable between an open state and a closed state. The clipboard 500 is illustrated in a partially open state in FIGS. 21 and 22 and in the closed state in FIGS. 23 and 24. In the closed state, the front surface 543 of the third panel 540 is adjacent to and in confronting relation with the front surface 513 of the first panel 510. Specifically, the third panel 540 is rotated about the second hinge 570 until the front surface 543 of the third panel 540 contacts or is at least closely adjacent to the front surface 513 of the first panel 510. When the third panel 540 is positioned in this manner, the third magnet 545 of the third panel 540 and the first magnet 515 of the first panel 510 are aligned with one another. More specifically, in this position opposite poles of the first and third magnets 515, 535 are aligned with one another to releasably secure the third panel 540 to the first panel 510 via magnetic attractive forces between the first and third magnets 510, 540. Furthermore, due to the smaller length of the third panel 540 relative to the first panel 510 as described above, the third panel 540 only covers and is only adjacent to a bottom portion 518 of the front surface 513 of the first panel 510.

When the third panel 540 is in this closed position, the third panel 540 can function as a clip for the clipboard 500. Thus, papers or other items can be sandwiched between the front surface 543 of the third panel 540 and the front surface 513 of the first panel 510. Furthermore, when the third panel 540 is in this closed position, the second panel 530 may be in an open position such that the front surface 533 of the second panel 530 is adjacent to and in confronting relation with the rear surface 514 of the first panel 510. When the second panel 530 is in this open position, the first and second magnets 515, 535 are adjacent to one another so that magnetic attractive forces between the first and second magnets 515, 535 releasably secures the second panel 530 to the rear surface 514 of the first panel 510. Although this positioning of the clipboard 500 is not illustrated in the figures, it should be readily understandable by persons of ordinary skill in the art. When the second panel 530 is in the open position, a top portion 519 of the front surface 513 of the first panel 510 is exposed, and any papers retained by the clipboard 500 and sandwiched between the first and third panels 510, 540 will be exposed for viewing or to be written on.

Furthermore, the second panel 530 can be rotated about the first hinge 560 so that the second panel 530 is also in a closed position in which the rear surface 534 of the second panel 530 is adjacent to and in confronting relation with the front surface 513 of the first panel 510. More specifically, in the closed position the rear surface 534 of the second panel 530 covers or overlies the top portion 519 of the front surface 513 of the first panel 510. Thus, in the closed position the second panel 530 may offer cover and protection of any papers or other items retained by the clipboard 500. When the second panel 530 is in the dosed position, opposite poles of the second magnet 535 of the second panel 530 and the third magnet 545 of the third panel 530 are adjacent to one another to releasably secure the second panel 530 to the third panel 534 via magnetic attractive forces between the second and third magnets 535, 545.

Thus, the clipboard 500 can be used in manner different manners. Specifically, the cardboard backer panel 601 of a legal pad 600 can be inserted into the slit 516 to retain the legal pad 600 on the clipboard 500. During such use, the second panel 530 can be opened to expose the legal pad 600 for display or use and closed to protect the legal pad 600. Furthermore, when the clipboard 500 retains a legal pad 600 using the slit 516, the third panel 540 can either be open or closed. When the clipboard 500 is used in this manner, the top end 512 of the first panel 510 forms a top of the clipboard 500. Furthermore, the third panel 540 has a thickness measured between the front and rear surfaces 543, 544 of the third panel 540. In certain embodiments the thickness of the third panel 540 is substantially equal to the thickness of a spine 603 of the legal pad 600. As a result, when the legal pad 600 is positioned inside of the clipboard 500 and the second panel 530 is in a closed position (FIG. 24), the first and second panels 510, 530 are oriented substantially parallel to one another.

Alternatively, the clipboard 500 can be used such that the third panel 540 operates as the clip/retaining structure of the clipboard 500. Thus, papers or other items can be retained between the third panel 540 and the first panel 510. Again, during such use the second panel 530 can be open to expose the paper or other items for display or use and closed to protect the paper or other items. When the clipboard 500 is used in this manner, the bottom end 511 of the first panel 510 forms a top of the clipboard 500. Thus, when used in this manner the clipboard 500 can be flipped/rotated for proper use.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A clipboard comprising:

a rigid first panel having a front surface, a rear surface, and a top end, the first panel comprising a first magnet;

a second panel having a front surface, a rear surface, and a top end, the first and second panels coupled together by a first hinge connecting the top end of the first panel to the top end of the second panel;

the second panel comprising:

a second hinge that divides the second panel into a cover portion and a clip portion; and a third hinge that divides the clip portion of the second panel into a first section and a second section, the first section comprising a second magnet;

wherein the second panel is adjustable between: (1) a closed position in which the second panel overlies the front surface of the first panel; and (2) an open position in which the cover portion of the second panel is adjacent to the rear surface of the first panel, the second section of the clip portion of the second panel overlies the first section of the clip portion of the second panel, the first section of the clip portion of the second panel overlies a top portion of the front surface of the first panel, and a bottom portion of the front surface of the first panel is exposed; and wherein opposite poles of the first and second magnets are aligned when the second panel is in both the open and closed positions to releasably secure, via magnetic attractive forces between the first and second magnets, the first section of the clip portion to the first panel to form a clip of the clipboard.

2. The clipboard in accordance with claim 1, wherein the second hinge has a first width measured between the cover portion of the second panel and the clip portion of the second panel, and wherein the third hinge has a second width measured between the first section of the clip portion and the second section of the clip portion, the first width being greater than the second width.

3. The clipboard in accordance with claim 1, wherein each of the second and third hinges is formed by a portion of the second panel that has a reduced thickness relative to adjacent portions of the second panel.

4. The clipboard in accordance with claim 1, wherein the first hinge is integrally formed with each of the first and second panels such that the first and second panels form a unitary structure, the first hinge being formed of a material having a reduced thickness relative to the top ends of the first and second panels.

5. The clipboard in accordance with claim 1, further comprising a third magnet positioned on the cover portion of the second panel and a fourth magnet positioned on the first panel, the third and fourth magnets located so that opposite poles of the third and fourth magnets are aligned with one another when the second panel is in the open position, the third and fourth magnets releasably securing, via magnetic attractive forces between the third and fourth magnets, the cover portion of the second panel to the rear surface of the first panel when the second panel is in the open position.

6. The clipboard in accordance with claim 5, wherein when the second panel is in the closed position the third and fourth magnets are not aligned with each other.

7. The clipboard in accordance with claim 1, wherein the second hinge extends along a first axis and the third hinge extends along a second axis, wherein the second panel extends from a bottom end to the top end along a longitudinal axis, and wherein the first and second axes are substantially parallel to one another and substantially perpendicular to the longitudinal axis.

8. The clipboard in accordance with claim 1, wherein the first section of the clip portion has a third width measured between the first and third hinges, wherein the second section of the clip portion has a fourth width measured between the second and third hinges, and wherein the cover portion of the second panel has a length measured between a bottom end of the second panel and the second hinge, the cover portion of the second panel being free of a hinge, and the third and fourth widths being substantially the same and being less than the length of the cover portion.

9. The clipboard in accordance with claim 1, wherein in the closed position the first and second sections of the clip portion are longitudinally spaced apart by the third hinge, and wherein in the open position the second section of the clip portion is positioned atop of the first section of the clip portion and the third hinge wraps around the top ends of the first and second panels.

10. The clipboard in accordance with claim 1, wherein when the second panel is in the open position, the clip portion is adjustable between: (1) a closed position in which the clip portion of the second panel overlies the top portion of the front surface of the first panel and the magnetic attractive forces between the first and second magnets is sufficiently strong to retain an item between the clip portion of the second panel and the front surface of the first panel; and (2) an open position in which the clip portion of the second panel is spaced from the front surface of the first panel and the top portion of the front surface of the first panel is exposed so that the item can be inserted into and removed from the clipboard.

11. The clipboard in accordance with claim 1, wherein the first panel, the cover portion of the second panel, and the first and second sections of the clip portion of the second panel are formed of a rigid material.

12. A clipboard comprising:

a first panel having a top end;

a second panel having a top end, the first and second panels coupled together by a first hinge connecting the top end of the first panel to the top end of the second panel;

the second panel comprising:

a second hinge that divides the second panel into a cover portion and a clip portion; and a third hinge that divides the clip portion of the second panel into a first section and a second section;

wherein the second hinge has a first width measured between the cover portion of the second panel and the second section of the clip portion of the second panel, and wherein the third hinge has a second width measured between the first section of the clip portion and the second section of the clip portion, the first width being greater than the second width; and wherein the second panel is adjustable between: (1) a closed position in which the second panel overlies and covers a front surface of the first panel; and (2) an open position in which the cover portion of the second panel is adjacent to a rear surface of the first panel so that a bottom portion of the front surface of the first panel is exposed, the second hinge of the second panel wraps around the top ends of the first and second panels and overlies the first hinge, and the clip portion of the second panel overlies a top portion of the front surface of the first panel.

13. The clipboard in accordance with claim 12, wherein when the second panel is in the open position the second section of the clip portion of the second panel overlies the first section of the clip portion of the second panel to form a clip of the clipboard.

14. The clipboard in accordance with claim 13, wherein when the second panel is in the open position the clip portion is adjustable between: (1) a closed position in which the clip portion of the second panel overlies the top portion of the front surface of the first panel to retain an item between the clip portion of the second panel and the front surface of the first panel; and (2) an open position in which the clip portion of the second panel is spaced from the top portion of the front surface of the first panel and the top portion of the front surface of the first panel is exposed so that the item can be inserted into and removed from the clipboard.

15. The clipboard in accordance with claim 14, wherein the first panel comprises a first fastening element and the first section of the clip portion of the second panel comprises a second fastening element, the first and second fastening elements aligned with one another to releasably secure the clip portion of the second panel to the first panel for retaining the item between the clip portion of the second panel and the front surface of the first panel.

16. A clipboard comprising:

a rigid first panel having a top end;

a second panel having a top end, the first and second panels coupled together by a first hinge connecting the top end of the first panel to the top end of the second panel;

the second panel comprising:

a second hinge that divides the second panel into a cover portion and a clip portion; and a third hinge that divides the clip portion of the second panel into a first section and a second section; and wherein the second panel is adjustable between: (1) a closed position in which the second panel overlies and covers a front surface of the first panel; and (2) an open position in which the cover portion of the second panel is adjacent to a rear surface of the first panel so that at least a portion of the front surface of the first panel is exposed, the second hinge of the second panel wraps around the top ends of the first and second panels and overlies the first hinge, the second section of the clip portion of the second panel overlies the first section of the clip portion of the second panel, and the clip portion of the second panel overlies a top portion of the front surface of the first panel.

17. The clipboard in accordance with claim 16, wherein when the second panel is in the open position the clip portion is adjustable between: (1) a closed position in which the clip portion of the second panel overlies the top portion of the front surface of the first panel to retain an item between the clip portion of the second panel and the front surface of the first panel; and (2) an open position in which the clip portion of the second panel is spaced from the top portion of the front surface of the first panel and the top portion of the front surface of the first panel is exposed so that the item can be inserted into and removed from the clipboard.

18. The clipboard in accordance with claim 17, wherein the first panel comprises a first magnet and the first section of the clip portion of the second panel comprises a second magnet, the first and second magnets aligned with one another to releasably secure, via magnetic attractive forces between the first and second magnets, the clip portion of the second panel to the first panel for retaining the item between the clip portion of the second panel and the front surface of the first panel.

* * * * *